US012716613B2

(12) United States Patent
Ikeda et al.

(10) Patent No.: US 12,716,613 B2
(45) Date of Patent: Aug. 25, 2026

(54) HEAT EXCHANGER SUPPORT DEVICE

(71) Applicant: Mitsubishi Electric Corporation, Tokyo (JP)

(72) Inventors: Mitsuhiro Ikeda, Tokyo (JP); Masashi Shiromura, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 182 days.

(21) Appl. No.: 18/838,473

(22) PCT Filed: Apr. 25, 2022

(86) PCT No.: PCT/JP2022/018710

§ 371 (c)(1),
(2) Date: Aug. 14, 2024

(87) PCT Pub. No.: WO2023/209767

PCT Pub. Date: Nov. 2, 2023

(65) Prior Publication Data

US 2025/0155158 A1 May 15, 2025

(51) Int. Cl.
*F24F 13/30* (2006.01)

(52) U.S. Cl.
CPC ..... *F24F 13/30* (2013.01)

(58) Field of Classification Search
CPC ..... F24F 13/30; F24F 13/222; F28F 17/005; F28F 2270/00; F28F 2265/14; F28F 2265/22

(Continued)

(56) References Cited

U.S. PATENT DOCUMENTS 6,497,255 B1 * 12/2002 Adams ..... F24F 13/0254 138/158
7,210,305 B2 * 5/2007 Shin ..... F24F 1/36 62/285

(Continued)

FOREIGN PATENT DOCUMENTS

JP S52-149358 U 11/1977
JP S56-078917 U 6/1981

(Continued)

OTHER PUBLICATIONS

Office Action dated Sep. 9, 2025 issued in corresponding JP patent application No. 2024-517623 (and English translation).

(Continued)

*Primary Examiner* — Jon T. Schermerhorn, Jr.
(74) *Attorney, Agent, or Firm* — Posz Law Group, PLC

(57) ABSTRACT

A heat exchanger support device is disposed between a heat exchanger and a base disposed below the heat exchanger, is made of a resin, and includes a base unit, a groove, a first drain hole, and a water guide face. The groove is formed in the base unit, is hollowed downward, and extends in a widthwise direction of the base unit. The first drain hole is opened at a first end of the groove in an extending direction of the groove and is a through-hole passing through a planar thickness of the groove. The water guide face is formed in the groove and progressively or continuously descends from a second end of the groove toward the first drain hole opened at the first end. The second end is positioned opposite to the first end in the extending direction of the groove.

11 Claims, 21 Drawing Sheets

(58) Field of Classification Search
USPC ..... 165/67
See application file for complete search history.

(56) References Cited

U.S. PATENT DOCUMENTS

| | | | | |
|---|---|---|---|---|
| 10,077,910 | B2 * | 9/2018 | Lee | F24F 1/46 |
| 11,009,241 | B2 * | 5/2021 | Nagashima | F24F 1/36 |
| 11,118,796 | B2 * | 9/2021 | Koike | F24F 1/16 |
| 11,193,678 | B2 * | 12/2021 | Kato | F28F 19/00 |
| 11,828,484 | B2 * | 11/2023 | Phillips | F28F 9/001 |
| 2005/0034471 | A1 | 2/2005 | Shin | |
| 2014/0298844 | A1 * | 10/2014 | Luo | F24F 1/50 62/275 |
| 2017/0314791 | A1 | 11/2017 | Yanase et al. | |
| 2019/0137119 | A1 | 5/2019 | Koike et al. | |
| 2020/0080733 | A1 | 3/2020 | Kato et al. | |
| 2020/0355376 | A1 | 11/2020 | Koike et al. | |
| 2021/0048221 | A1 * | 2/2021 | Groen | F28D 7/163 |
| 2022/0049857 | A1 | 2/2022 | Shimazaki et al. | |

FOREIGN PATENT DOCUMENTS

| | | | |
|---|---|---|---|
| JP | 2010-038486 | A | 2/2010 |
| JP | 2010-151387 | A | 7/2010 |
| JP | 6361685 | B2 | 7/2018 |
| JP | 2018-128231 | A | 8/2018 |
| JP | 2018-151103 | A | 9/2018 |
| JP | 2019-132543 | A | 8/2019 |
| JP | 6785877 | B2 | 11/2020 |
| JP | 2020/148888 | A1 | 9/2021 |
| WO | 2008/084277 | A1 | 7/2008 |
| WO | 2013/088713 | A1 | 6/2013 |

OTHER PUBLICATIONS

Extended European Search Report dated May 21, 2025 issued in the corresponding European Patent Application No. 22940048.6.
International Search Report of the International Searching Authority mailed Jun. 7, 2022 in corresponding International Patent Application No. PCT/JP2022/018710 (and English Translation).

* cited by examiner

HEAT EXCHANGER SUPPORT DEVICE

CROSS REFERENCE TO RELATED APPLICATION

This application is a U.S. national stage application of PCT/JP2022/018710 filed on Apr. 25, 2022, the contents of which are incorporated herein by reference.

TECHNICAL FIELD

The present disclosure relates to a heat exchanger support device that supports a heat exchanger.

BACKGROUND ART

As a typical type of air-conditioning apparatus, an air-conditioning apparatus configured to perform a cooling operation and a heating operation by switching the flows of refrigerant by use of a flow switching device, such as a four-way valve, is known. When the air-conditioning apparatus performs the heating operation in the environment where outside temperature is low, frost adheres to a heat exchanger of an outdoor unit, thereby lowering the heat exchange efficiency. For this reason, the outdoor unit typically has a defrost function.

The outdoor unit causes frost melted by a defrost operation to flow downward as melt water. The melt water is received by a metal base disposed at a lower internal space of the outdoor unit and is then drained to the outside from a drain hole opened in the metal base. However, the metal base has a corrugated shape and because of this shape, part of the melt water received by the metal base may not reach the drain hole and remain on the metal base. After the air-conditioning apparatus finishes the defrost operation and returns to the heating operation, the melt water remaining on the metal base is frozen again when the outside temperature is below the freezing point of water. Because the defrost operation for the heat exchanger is regularly performed, the frozen melt water is expanded, and the entire metal base is covered with ice.

When the metal base is covered with ice in this manner, the drain hole opened in the metal base is blocked by the ice, thereby failing to drain melt water. This promotes the growth of ice to the bottom portion of the heat exchanger, which crushes aluminum fins provided in the heat exchanger. When ice further grows to reach heat transfer tubes, the heat transfer tubes are damaged, leading to a leakage of a refrigerant gas in the worst case.

Additionally, when a heat exchanger includes heat transfer tubes axially extending in the up-down direction, a heat exchanger header, such as a liquid header and a gas header, is provided at the bottom portion of the heat exchanger. The heat exchanger header is made of aluminum and may be damaged by ice that has grown. Hence, when a heat exchanger header is provided at the bottom portion of a heat exchanger, the risk of a gas leakage caused by the freezing and the melting of water becomes even higher.

To address this issue, Patent Literature 1, for example, discloses a technology for preventing melt water from being frozen by installing a freeze preventing heater on the metal base of the outdoor unit.

CITATION LIST

Patent Literature

Patent Literature 1: International Publication No. 2013/088713

SUMMARY OF INVENTION

Technical Problem

As in the outdoor unit disclosed in Patent Literature 1, however, even with the freeze preventing heater installed on the metal base, the freezing of melt water is not completely prevented. That is, in actuality, the freeze preventing heater merely melts ice in the vicinity of the freeze preventing heater, and melt water still freezes in an area without the freeze preventing heater. As a result, the top portion of the freeze preventing heater is eventually frozen and ice is formed on the entire surface of the metal base. This may damage some elements of the heat exchanger, such as aluminum fins and heat transfer tubes.

Additionally, the heat exchanger header is made of an aluminum material, while the metal base is made of a steel plate, thereby increasing the occurrence of galvanic corrosion. Galvanic corrosion may cause the removal of a coating, for example, and the removal of a coating on the metal base, for example, directly leads to a serious defect.

The present disclosure has been made to solve the above-described problems. It is an object of the present disclosure to provide a heat exchanger support device configured to prevent damage to a heat exchanger, which would be caused by the freezing of the heat exchanger, by efficiently draining drain water from the heat exchanger and also configured to reduce the occurrence of galvanic corrosion. In the following description, drain water includes melt water generated from frost melted by a defrost operation and drain water caused by moisture condensation in air and adhering to the surface of heat transfer tubes.

Solution to Problem

A heat exchanger support device of an embodiment of the present disclosure is a heat exchanger support device that is disposed between a heat exchanger and a base, which is disposed below the heat exchanger. The heat exchanger support device is made of a resin. The heat exchanger support device includes a base unit, a groove, a first drain hole, and a water guide face. The base unit has an elongated and planar shape and includes a main surface, which is flat. The groove is formed in the main surface of the base unit. The groove is hollowed downward from the main surface and extends in a widthwise direction of the base unit. The first drain hole is opened at a first end of the groove, which is an end in an extending direction of the groove. The first drain hole is a through-hole passing through a planar thickness of the groove. The water guide face is formed in the groove and progressively or continuously descends from a second end of the groove toward the first drain hole opened at the first end. The second end is positioned opposite to the first end in the extending direction of the groove.

Advantageous Effects of Invention

A heat exchanger support device according to an embodiment of the present disclosure is configured to cause drain water to flow down on a water guide face in a groove and to be drained to the outside through a first drain hole opened in a resin. Drain water of a heat exchanger is thus drained without contacting a base. This prevents damage to the heat exchanger, which would be caused by drain water becoming frozen on the base. The heat exchanger support device is made of a resin and is disposed between the base made of steel and the heat exchanger made of aluminum, thereby making it possible to reduce the occurrence of galvanic corrosion.

DESCRIPTION OF EMBODIMENTS

Figure 1:
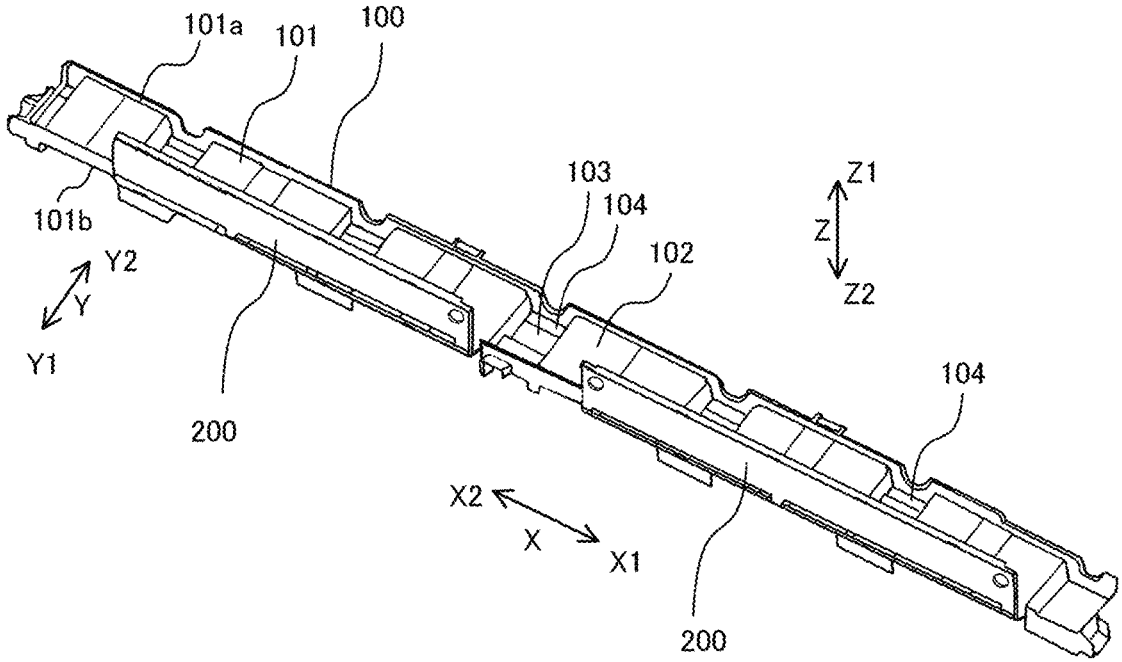
FIG. 1 is a perspective view illustrating the configuration of a heat exchanger support device 100 according to Embodiment 1.

A heat exchanger support device according to the present disclosure will be described below with reference to the drawings. The present disclosure is not limited to the following embodiment and may be variously modified without departing from the scope and the spirit of the present disclosure. The present disclosure includes all kinds of combinations of the configurations of the following embodiment and modified examples when such combinations are possible. In the drawings, elements designated by the same reference sign are the same element or corresponding elements. This applies to all text throughout the specification. The relative relationship between the sizes of elements or the shapes of the elements shown in the drawings may be different from those of actual elements. In the drawings, the Z direction represents the up-down direction. The Z direction is a vertical direction, for example. The X direction is a direction intersecting with the Z direction and represents the longitudinal direction of the heat exchanger support device. The X direction is a horizontal direction, for example. The X direction may be called the widthwise direction of a heat exchanger. The Y direction is a direction intersecting with the Z direction and the X direction and represents the widthwise direction of the heat exchanger support device. The Y direction is a horizontal direction, for example. The Y direction may be called the depth direction of the heat exchanger.

Embodiment 1

(Configuration of Heat Exchanger Support Device 100)

Figure 2:
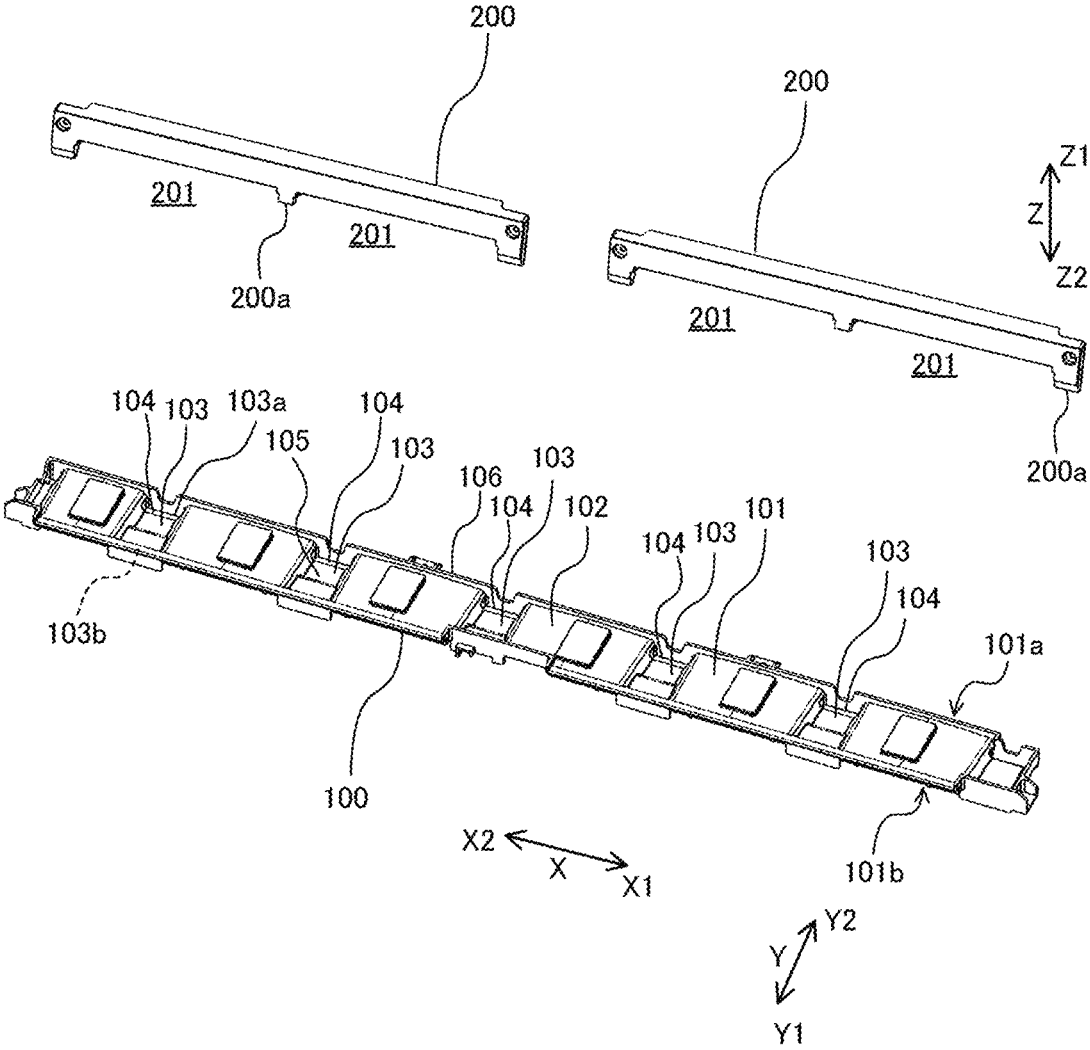
FIG. 2 is an exploded perspective view illustrating the configuration of the heat exchanger support device 100 according to Embodiment 1.
Figure 3:
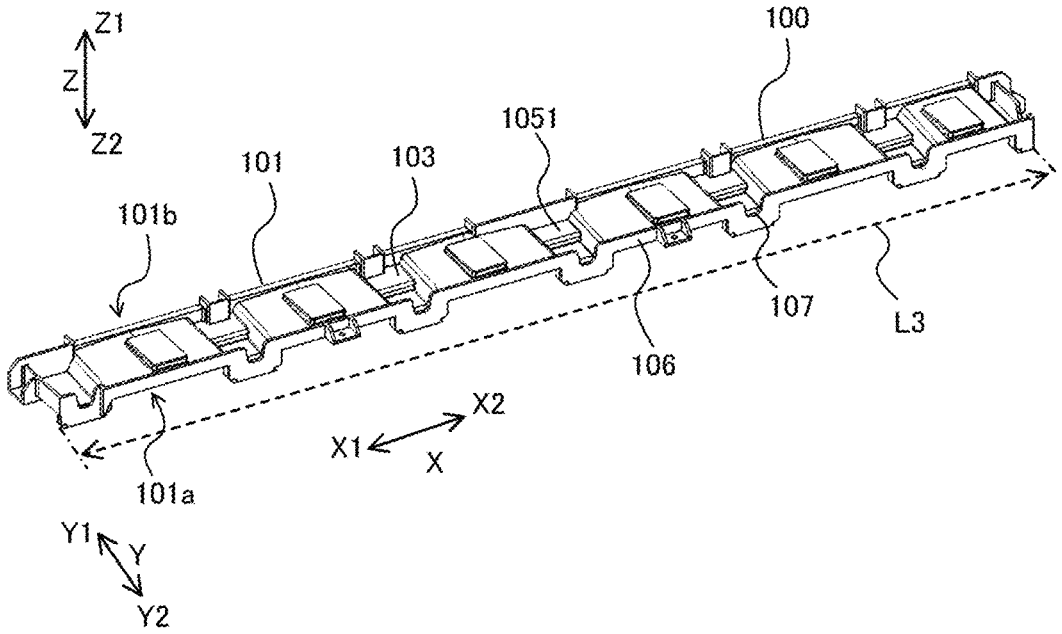
FIG. 3 is a perspective view illustrating a base unit 101 provided in the heat exchanger support device 100 according to Embodiment 1.
Figure 4:
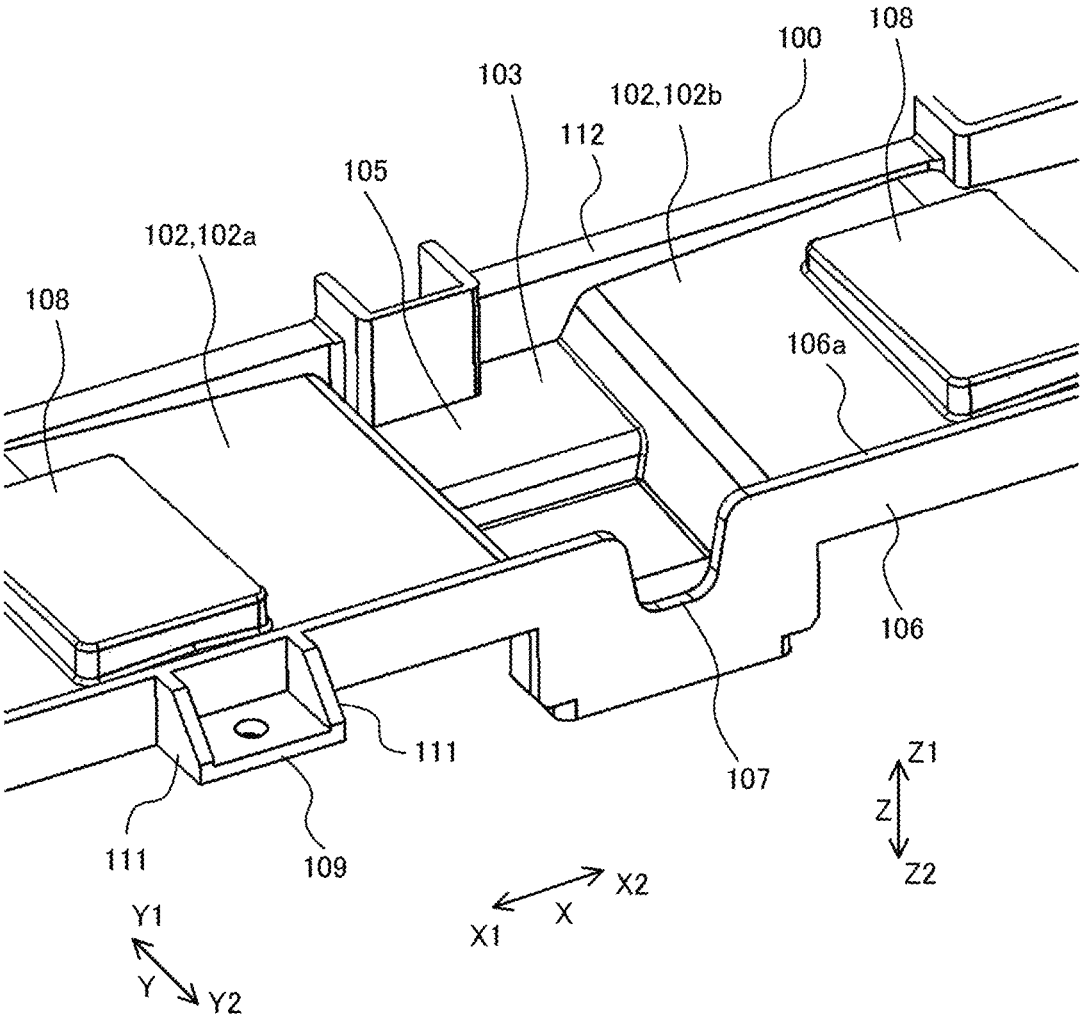
FIG. 4 is an enlarged partial perspective view illustrating the configuration of the base unit 101 provided in the heat exchanger support device 100 according to Embodiment 1.
Figure 5:
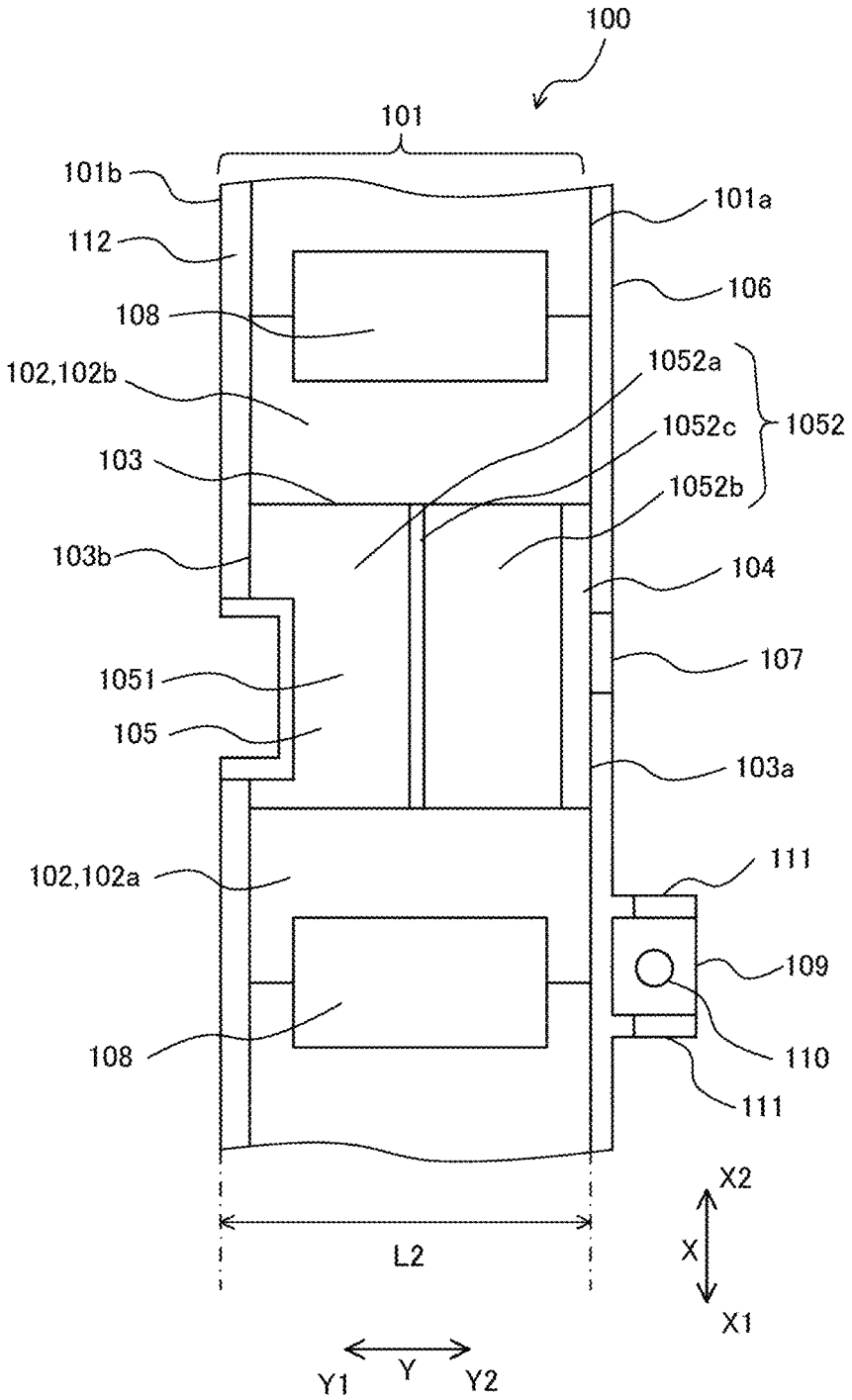
FIG. 5 is a schematic plan view schematically illustrating the configuration of the base unit 101 provided in the heat exchanger support device 100 according to Embodiment 1.

The configuration of a heat exchanger support device 100 will be described below with reference to FIGS. 1 through 5. FIG. 1 is a perspective view illustrating the configuration of the heat exchanger support device 100 according to Embodiment 1. FIG. 2 is an exploded perspective view illustrating the configuration of the heat exchanger support device 100 according to Embodiment 1. FIG. 3 is a perspective view illustrating a base unit 101 provided in the heat exchanger support device 100 according to Embodiment 1. FIG. 4 is an enlarged partial perspective view illustrating the configuration of the base unit 101 provided in the heat exchanger support device 100 according to Embodiment 1. FIG. 5 is a schematic plan view schematically illustrating the configuration of the base unit 101 provided in the heat exchanger support device 100 according to Embodiment 1.

Figure 8:
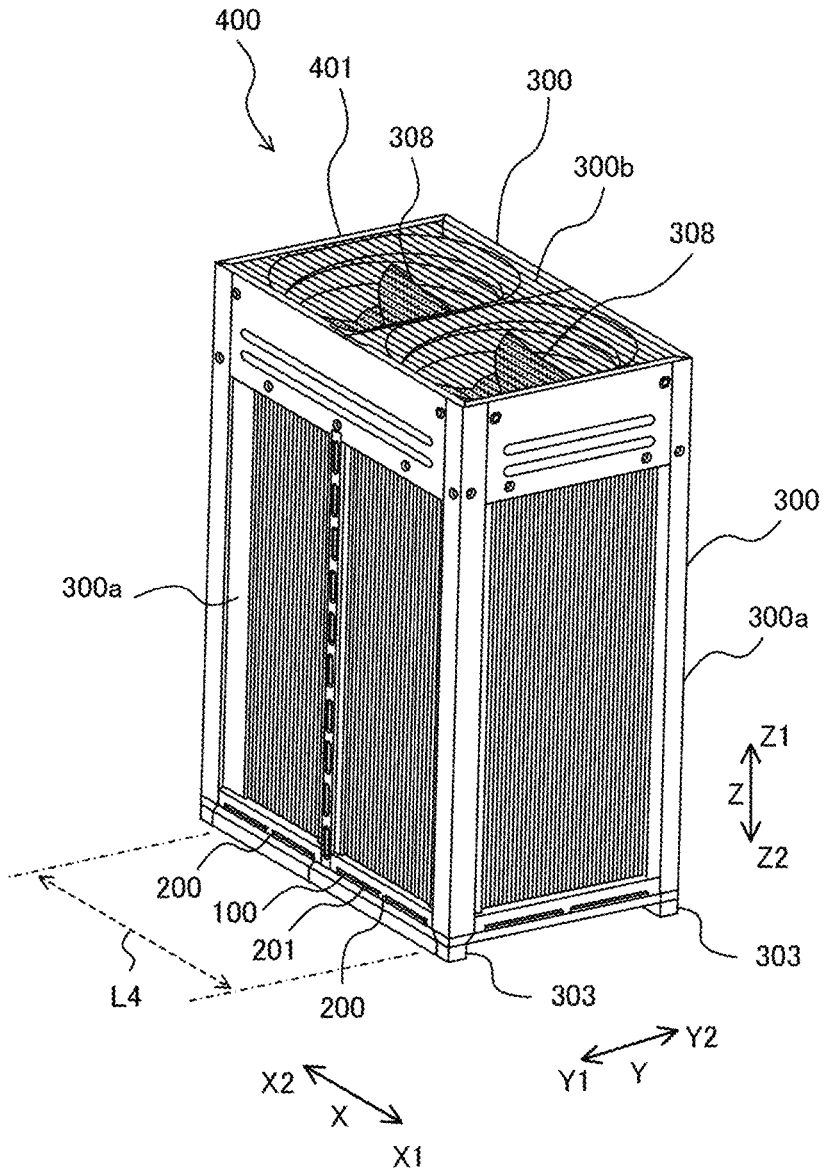
FIG. 8 is a perspective view illustrating the external appearance of an outdoor unit 401 according to Embodiment 1.

The heat exchanger support device 100 according to Embodiment 1 is a device that supports a heat exchanger 304 (see FIG. 6) housed in an outdoor unit 401 (see FIG. 8) of an air-conditioning apparatus 400 (see FIG. 8). The heat exchanger support device 100 is made of a resin. The heat exchanger support device 100 is disposed below a side surface 300*a* of a housing 300 of the outdoor unit 401, as illustrated in FIG. 8, which will be discussed later. In FIGS. 1 through 5, a Y1 direction of the Y direction is a direction from the inner side of the housing 300 to the outside, while a Y2 direction of the Y direction is a direction from the outer side to the inner side of the housing 300. FIGS. 1 and 2 illustrate a state in which the heat exchanger support device 100 is seen in the direction from the outer side to the inner side. FIGS. 3 and 4 illustrate a state in which the heat exchanger support device 100 is seen in the direction from the inner side to the outer side. The heat exchanger support device 100 is disposed between the heat exchanger 304 (see FIG. 6) stored in the housing 300 and a base 301, which will be discussed later, disposed below the heat exchanger 304 in the housing 300.

As illustrated in FIGS. 1 through 5, the heat exchanger support device 100 includes a base unit 101 having a main surface 102, a groove 103, a first drain hole 104, and a water guide face 105.

The base unit 101 forms the body of the heat exchanger support device 100. The base unit 101 has an elongated and planar shape. The base unit 101 has an inner edge 101*a*, which is one edge of the base unit 101 in the widthwise direction, and an outer edge 101*b*, which is the other edge of the base unit 101 in the widthwise direction. The inner edge 101*a* and the outer edge 101*b* both extend in the longitudinal direction of the base unit 101. When the heat exchanger support device 100 is mounted on the housing 300 of the outdoor unit 401, the inner edge 101*a* is positioned in an internal space of the housing 300 (see FIG. 8), while the outer edge 101*b* is positioned on the outer side of the housing 300 (see FIG. 8). The base unit 101 has a flat main surface 102, which will be discussed later. The base unit 101 also has a side flat portion 112, as shown in FIGS. 4 and 5. The side flat portion 112 is provided at the outer edge 101*b* and extends in the X direction. The side flat portion 112 is disposed horizontally and thus parallel with the XY plane. The position of the side flat portion 112 in the Z direction, that is, the height position, may be the same as the position of a top end 106*a* of a side rib 106, which will be discussed later, in the Z direction, or may be different from the position of the top end 106*a*.

The groove 103 is formed in the main surface 102 of the base unit 101. The groove 103 is a hollow, which is hollowed downward from the main surface 102. The groove 103 extends in the widthwise direction of the base unit 101. As shown in FIG. 2, the groove 103 has a first end 103*a*, which is one end of the groove 103 in the extending direction, and a second end 103*b*, which is the other end of the groove 103 in the extending direction. The first end 103*a* is located closer to the inner edge 101*a* of the base unit 101 than is the second end 103*b*, which is located closer to the outer edge 101*b* of the base unit 101, than is the first end 103*a*. As shown in FIG. 2, plural grooves 103 are each disposed with an associated space in between in the longitudinal direction of the base unit 101.

The first drain hole 104 is located at the first end 103*a* of the groove 103, as shown in FIG. 2. The first drain hole 104 is a through-hole passing through the planar thickness of the groove 103. The first drain hole 104 has a rectangular shape, for example, as viewed from above, as shown in FIGS. 2 and 5.

The water guide face 105 is formed inside the groove 103. The water guide face 105 progressively or continuously descends from the second end 103*b* of the groove 103 toward the first drain hole 104. That is, as shown in FIG. 3, the water guide face 105 has a step portion 1051 that progressively descends from the second end 103*b* of the groove 103 toward the first drain hole 104. Alternatively, the water guide face 105 has a tilt surface 1052 (see FIG. 7) that continuously descends from the second end 103*b* of the groove 103 toward the first drain hole 104. The water guide face 105 may be formed by a combination of the step portion 1051 and the tilt surface 1052. That is, the step portion 1051 may have the tilt surface 1052. In Embodiment 1, the step portion 1051 having the tilt surface 1052 will be explained as an example. This will be described below specifically.

Figure 6:
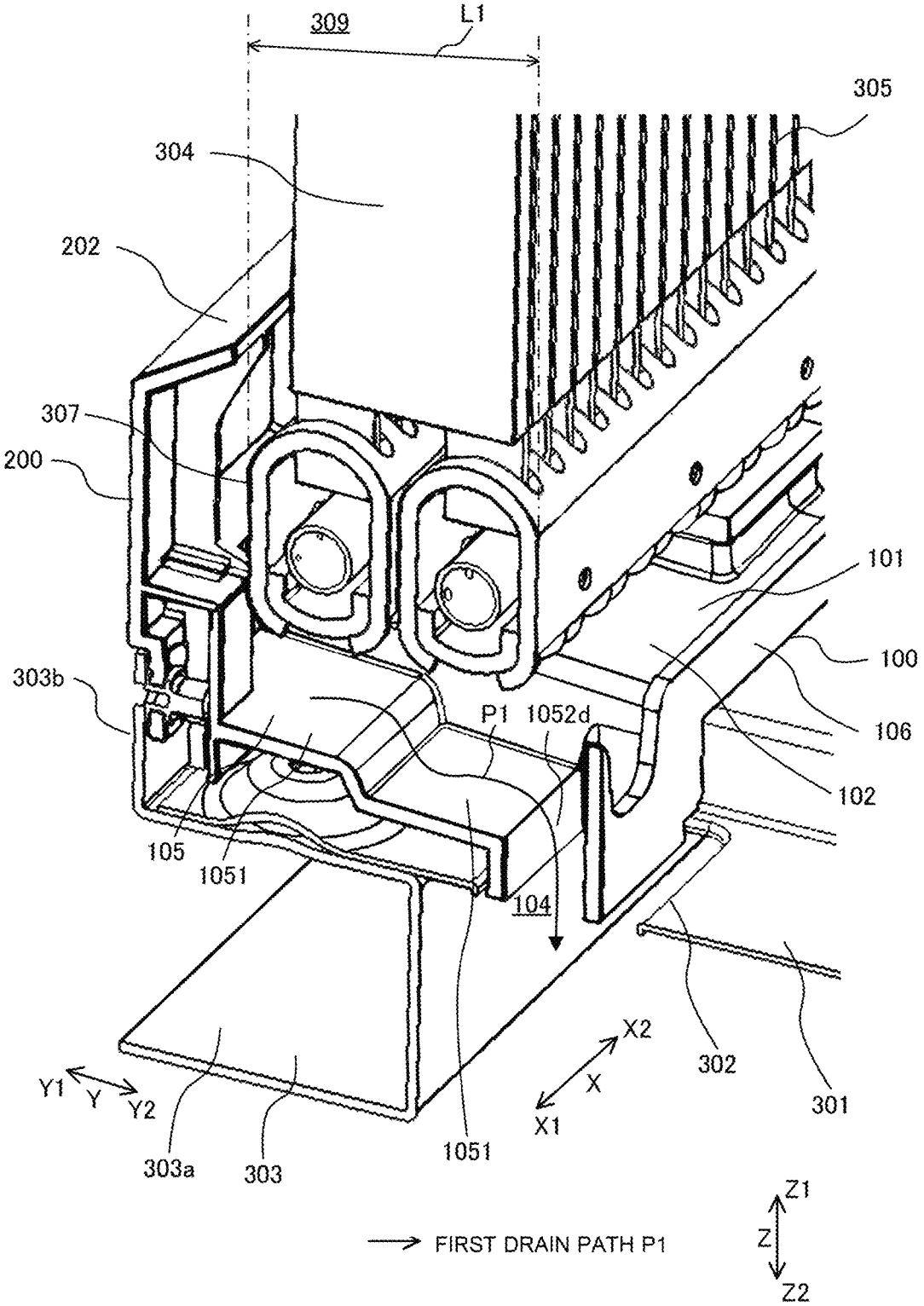
FIG. 6 is a perspective sectional view illustrating the configuration of a groove 103 provided in the heat exchanger support device 100 according to Embodiment 1.

FIG. 6 is a perspective sectional view illustrating the configuration of the groove 103 provided in the heat exchanger support device 100 according to Embodiment 1. In FIG. 6, a cross section obtained by cutting the groove 103 in the heat exchanger support device 100 along a virtual plane parallel with the YZ plane is shown. As illustrated in FIG. 6, the water guide face 105 is formed in the groove 103. Drain water generated and collected on the surface of the heat exchanger flows on the water guide face 105, as indicated by the arrow in FIG. 6. The water guide face 105 has the step portion 1051, as shown in FIG. 6. In the example in FIG. 6, the step portion 1051 progressively descends in two steps from the second end 103*b* of the groove 103 toward the first drain hole 104. The number of steps of the step portion 1051 is not limited to two and may be determined appropriately.

Figure 7:
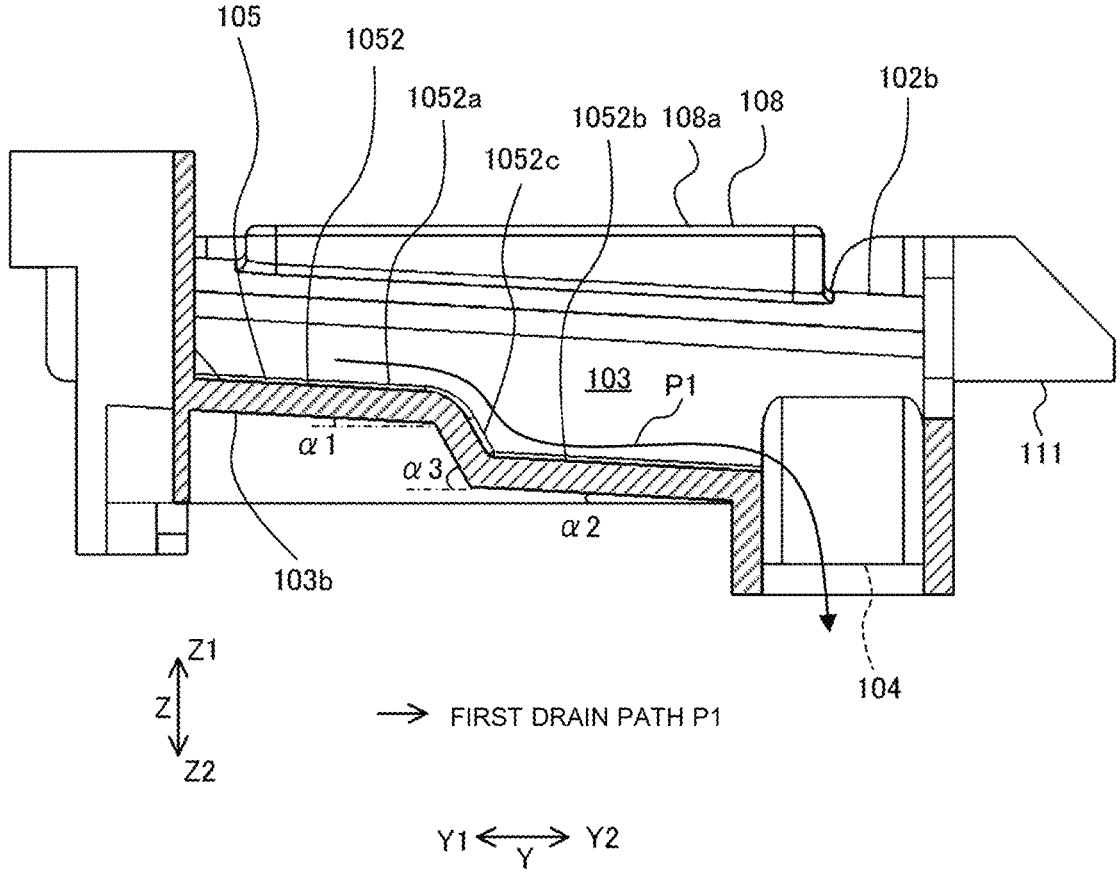
FIG. 7 is a sectional view illustrating the configuration of the groove 103 provided in the heat exchanger support device 100 according to Embodiment 1.

FIG. 7 is a sectional view illustrating the configuration of the groove 103 provided in the heat exchanger support device 100 according to Embodiment 1. As illustrated in FIG. 7, the water guide face 105 has the tilt surface 1052. The tilt surface 1052 continuously descends from the second end 103*b* of the groove 103 toward the first drain hole 104. In the example in FIG. 7, because of the provision of the step portion 1051, a step is formed on the tilt surface 1052. Alternatively, the provision of a step may be omitted, namely, the tilt surface 1052 may be one tilt surface.

In the example in FIG. 7, the tilt surface 1052 includes a first tilt surface portion 1052*a*, a second tilt surface portion 1052*b*, and a third tilt surface portion 1052*c*. The first tilt surface portion 1052*a* continuously descends in a direction from the second end 103*b* (see FIG. 5) toward the first end 103*a* (see FIG. 5) at a first tilt angle $\alpha 1$. The second tilt surface portion 1052*b* is located closer to the first end 103*a* than is the first tilt surface portion 1052*a*. That is, the second tilt surface portion 1052*b* is located closer to the first end 103*a* than is the first tilt surface portion 1052*a*. The second tilt surface portion 1052*b* continuously descends in a direction from the second end 103*b* (see FIG. 5) toward the first end 103*a* (see FIG. 5) at a second tilt angle $\alpha 2$. The third tilt surface portion 1052*c* links the first tilt surface portion 1052*a* and the second tilt surface portion 1052*b* to each other. The third tilt surface portion 1052*c* continuously descends in a direction from the second end 103*b* (see FIG. 5) toward the first end 103*a* (see FIG. 5) at a third tilt angle $\alpha 3$. The third tilt angle $\alpha 3$ is larger than each of the first tilt angle $\alpha 1$ and the second tilt angle $\alpha 2$. That is, the third tilt surface portion 1052*c* is the steepest surface. The first tilt angle $\alpha 1$ is larger than or equal to the second tilt angle $\alpha 2$. More specifically, the first tilt angle $\alpha 1$ is about 4 to 5 degrees, the second title angle $\alpha 2$ is about 3 to 4 degrees, and the third tilt angle $\alpha 3$ is about 60 degrees. These numerical values are only examples, and the tilt angles are not limited to the examples.

It has been explained that the step portion 1051 has two steps. This will be explained by taking the example in FIGS. 6 and 7. The step of the third tilt surface portion 1052*c* from the first tilt surface portion 1052*a* to the second tilt surface portion 1052*b* in the example in FIG. 7 is a first step, while a step 1052*d* from the second tilt surface portion 1052*b* toward the first drain hole 104 in FIG. 6 is a second step. In this manner, in Embodiment 1, a combination of the step portion 1051 and the tilt surface 1052 forms the water guide face 105. Providing one or more tilt surfaces 1052 in the step portion 1051 increases the flowrate of drain water and speedily discharges drain water. In Embodiment 1, the steep third tilt surface portion 1052*c* is provided at the center of the step portion 1051 in the Y direction. Accordingly, even when the flowrate of drain water temporarily slows down on the first tilt surface portion 1052*a* because of the influence of accumulated wastes, for example, the drain water accelerates again on the third tilt surface portion 1052*c* and continues to flow down toward the second tilt surface portion 1052*b*. This prevents drain water from being stagnant and accumulated on the water guide face 105.

The heat exchanger support device 100 includes a side rib 106, as shown in FIG. 4. As illustrated in FIGS. 2 and 3, the side rib 106 is located at the inner edge 101*a* of the base unit 101. The side rib 106 has an elongated and planar shape extending in the longitudinal direction of the inner edge 101*a* of the base unit 101. The side rib 106 rises upward from the inner edge 101*a* in the Z direction. As shown in FIG. 3, the side rib 106 has a corrugated shape in a side view. That is, the side rib 106 has projecting portions protruding downward at positions corresponding to the positions of the grooves 103 in the base unit 101, and the remaining portions of the side rib 106 have an elongated, rectangular shape extending in the X direction. In this manner, the side rib 106 has projecting portions located at positions corresponding to the grooves 103 formed in the longitudinal direction of the base unit 101 and rectangular, planar portions each positioned between corresponding projecting portions.

As shown in FIG. 4, a notch 107 is cut in the side rib 106. The notch 107 is cut at a top end 106*a* of the side rib 106. As illustrated in FIGS. 2 through 4, multiple notches 107 are cut at positions corresponding to the positions of the grooves 103 in the longitudinal direction of the base unit 101. The notches 107 are hollowed downward in the Z direction from the top end 106*a* of the side rib 106.

Under normal conditions, drain water passes through the water guide face 105 and flows toward the first drain hole 104 along a first drain path P1, as indicated by the arrow in FIG. 6. As shown in FIG. 6, the first drain hole 104 is located at a position corresponding to the position of a second drain hole 302 opened in a base 301, which will be discussed later. The first drain hole 104 is located right above the second drain hole 302 or is located inward of the second drain hole 302 and positioned at the same level as the second drain hole 302. The water guide face 105 and the first drain hole 104 define the first drain path P1 through which drain water flows. In the first drain path P1, drain water is allowed to flow on the water guide face 105, pass through the first drain hole 104, and be directly drained to the outside of the housing 300 of the outdoor unit 401 without contacting the base 301.

However, there may be a case in which drain water is frozen in the vicinity of the first drain hole 104 and the first drain hole 104 is blocked by the frozen water. In this case, drain water passes through the water guide face 105 and then flows through the notch 107 cut in the side rib 106, as indicated by the arrow in FIG. 15, which will be discussed later. The water guide face 105 and the notch 107 define a second drain path P2, which is used when the first drain hole 104 is frozen. In the second drain path P2, drain water passes through the water guide face 105 and the notch 107 and flows toward the base 301 located inside the housing 300. The drain water then flows from the base 301 toward the outside of the housing 300 of the outdoor unit 401 and is drained.

As illustrated in FIGS. 1 and 2, the heat exchanger support device 100 includes a heat exchanger protection wall 200. The heat exchanger protection wall 200 is provided at the outer edge 101*b*, which is an edge of the base unit 101 in the widthwise direction. The heat exchanger protection wall 200 has an elongated and planar shape extending in the longitudinal direction of the outer edge 101*b* of the base unit 101. The heat exchanger protection wall 200 rises upward in the Z direction from the outer edge 101*b*. The heat exchanger protection wall 200 and the side rib 106 thus face each other.

As illustrated in FIG. 6, the heat exchanger 304 includes a heat exchanger header 307 connected to the bottom ends of multiple heat transfer tubes 305. The heat exchanger header 307 serves as a liquid header or a gas header. As shown in FIG. 6, the heat exchanger protection wall 200 is disposed further outward of the housing 300 (see FIG. 8) of the outdoor unit 401 (see FIG. 8) than the heat exchanger header 307. That is, the heat exchanger protection wall 200 is disposed on the outer side of the heat exchanger header 307 and covers the heat exchanger header 307, as shown in FIG. 6. The heat exchanger protection wall 200 and the heat exchanger header 307 do not contact each other and are separate from each other with a space in between. The heat exchanger protection wall 200 has a top bending portion 202 at the top of the heat exchanger protection wall 200. In the direction to the forward end of the top bending portion 202, the top bending portion 202 is inclined toward the heat exchanger 304 in the Z direction. The top bending portion 202 is bent along the outer shape of the top end of the heat exchanger header 307 and thus covers the top end of the heat exchanger header 307 from above. The top bending portion 202 and the top end of the heat exchanger header 307 do not contact each other and are separate from each other with a space in between. In this manner, the heat exchanger protection wall 200 is disposed such that the heat exchanger protection wall 200 covers the heat exchanger header 307, thereby protecting the heat exchanger header 307 from damage, which may be caused by foreign matter, such as small stones, collided with the heat exchanger header 307. Since the heat exchanger protection wall 200 is disposed on the outer side of the heat exchanger header 307, it also serves as a windbreak panel for the heat exchanger header 307. The heat exchanger protection wall 200 thus prevents the heat exchanger header 307 from being frozen caused by wind. Because of the provision of the heat exchanger protection wall 200, outside air is taken into the outdoor unit 401 from the side surfaces 300*a* of the housing 300 for the heat exchanger 304 to allow heat exchange. Without the heat exchanger protection wall 200, outside air is also sucked in from downward of the housing 300. This outside air is not used for heat exchange, thereby lowering the heat exchange efficiency of the heat exchanger 304. In Embodiment 1, the provision of the heat exchanger protection wall 200 maintains the heat exchange efficiency. The heat exchanger protection wall 200 also prevents the entry of insects into the housing 300.

The heat exchanger protection wall 200 includes drain gates 201, as shown in FIG. 2. The drain gates 201 are provided at the bottom end of the heat exchanger protection wall 200. The drain gates 201 are formed such that the drain gates 201 are hollowed upward in the Z direction from a bottom end 200*a* of the heat exchanger protection wall 200.

The drain gates 201 are narrow, slit-like gaps longitudinally extending in the X direction. The drain gates 201 define a fourth drain path P4, which will be discussed later, for draining drain water. The drain gates 201 are formed in a size that allows water to pass through the drain gates 201 and makes it difficult for foreign matter, such as small stones, wind, and insects, to enter.

The heat exchanger protection wall 200 is made of a resin. The heat exchanger protection wall 200 may be formed as part of the heat exchanger support device 100, integrally with the base unit 101, for example. Alternatively, the heat exchanger protection wall 200 may be formed separately from the heat exchanger support device 100, such as the base unit 101, and be attached to the base unit 101, as shown in the exploded perspective view of FIG. 2.

The base unit 101, main surface 102, groove 103, first drain hole 104, water guide face 105, side rib 106, notch 107, and projecting portion 108, which will be discussed later, are integrally formed from a resin.

(Configuration of Outdoor Unit 401)

Figure 9:
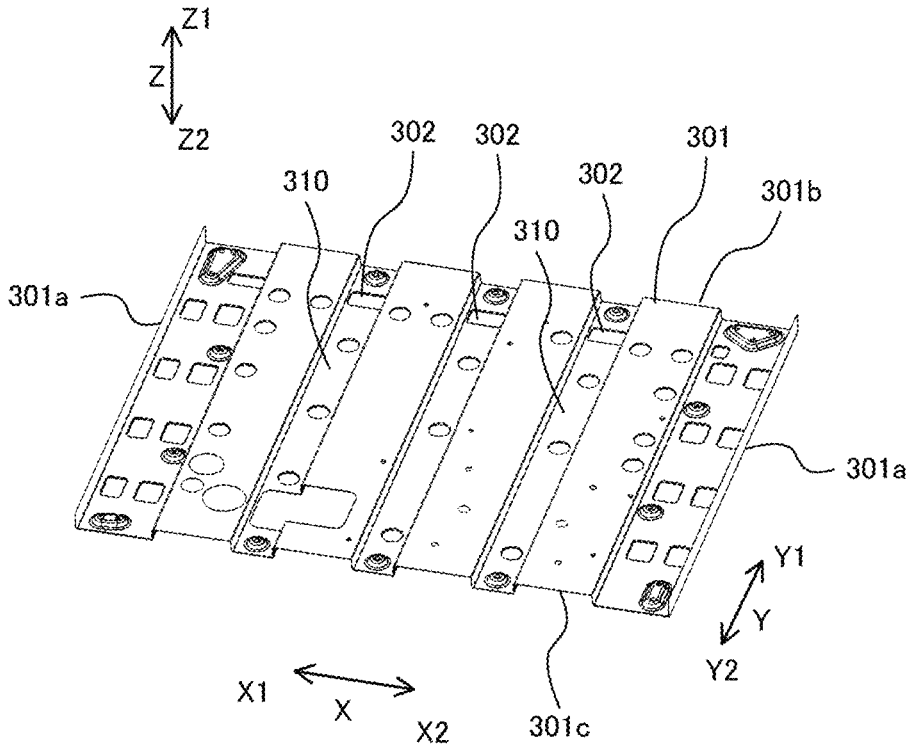
FIG. 9 is a perspective view illustrating the configuration of a base 301 located inside a housing 300 of the outdoor unit 401 according to Embodiment 1.
Figure 10:
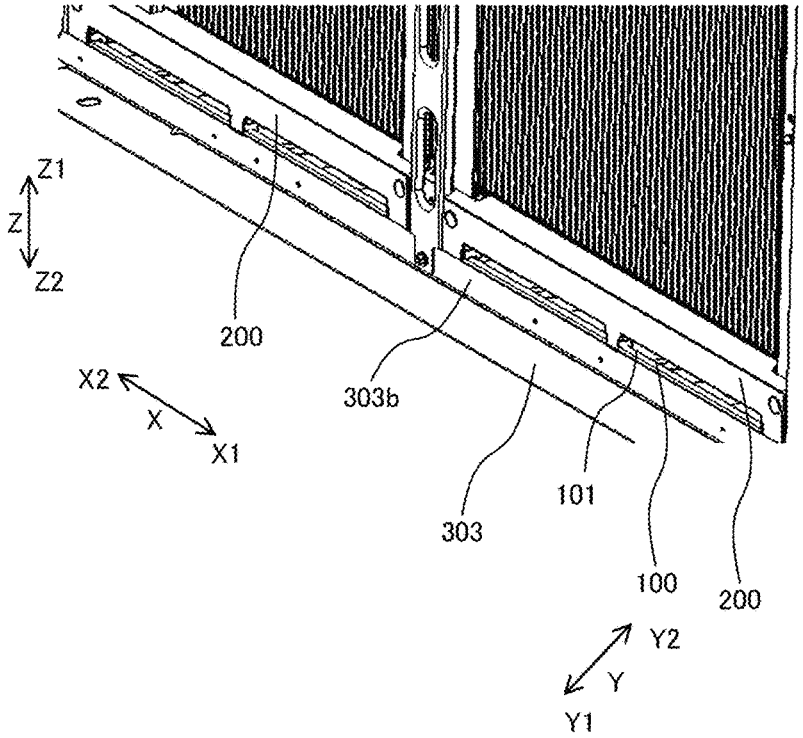
FIG. 10 is an enlarged partial perspective view illustrating the configuration of a bottom portion of the outdoor unit 401 according to Embodiment 1.
Figure 11:
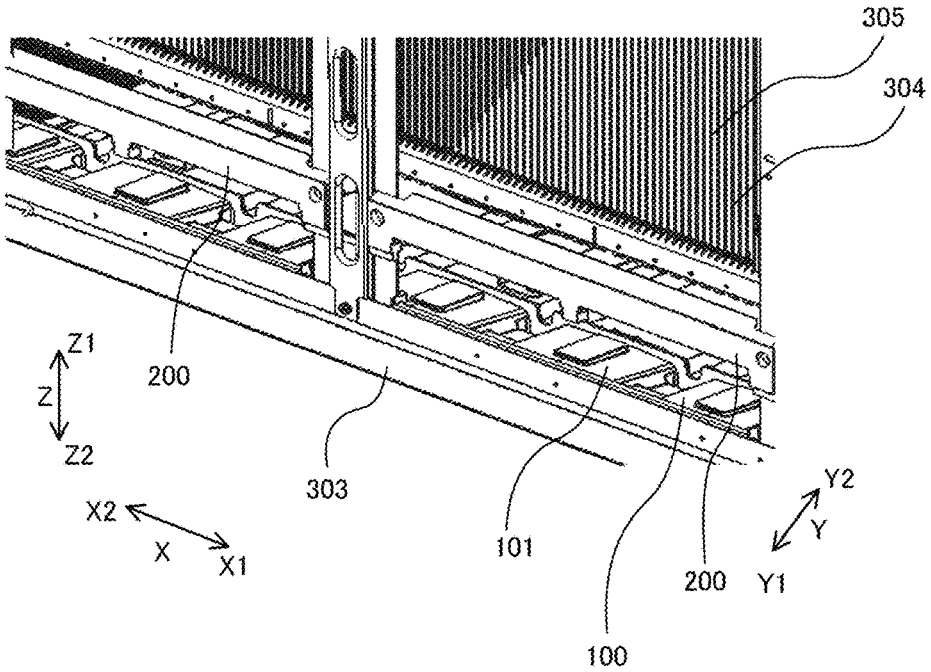
FIG. 11 is an exploded perspective view illustrating the configuration of the bottom portion of the outdoor unit 401 according to Embodiment 1.
Figure 12:
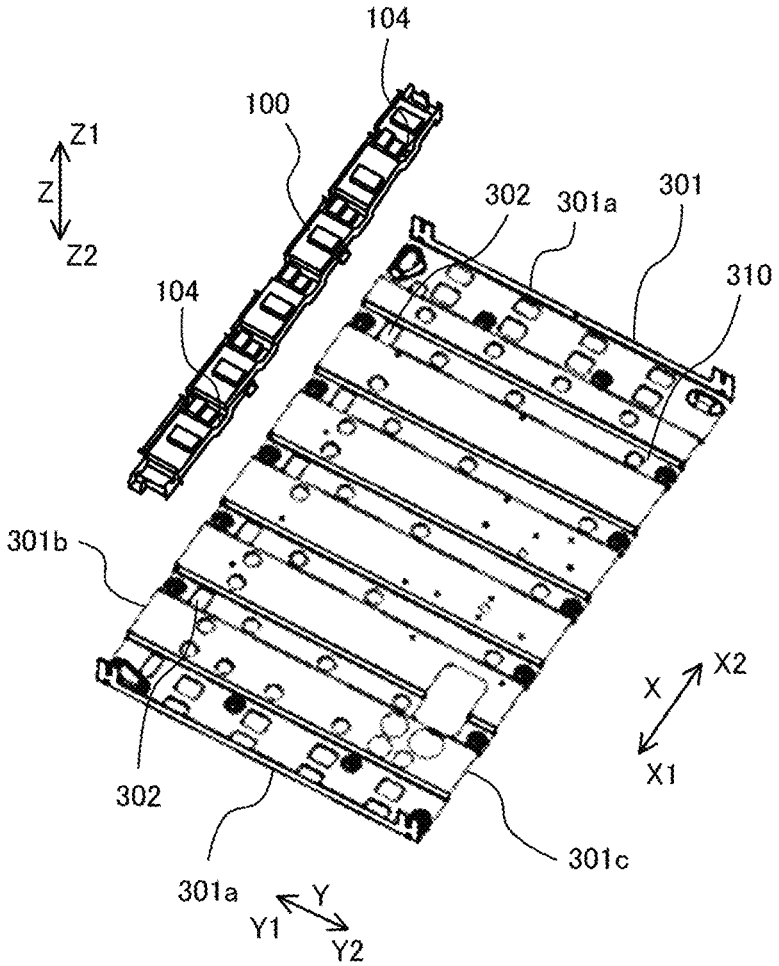
FIG. 12 is a perspective view illustrating the configurations of the base 301 and the heat exchanger support device 100 according to Embodiment 1.

The configuration of the outdoor unit 401 of the air-conditioning apparatus 400 will be explained below with reference to FIGS. 8 through 12. FIG. 8 is a perspective view illustrating the external appearance of the outdoor unit 401 according to Embodiment 1. FIG. 9 is a perspective view illustrating the configuration of the base 301 located inside the housing 300 of the outdoor unit 401 according to Embodiment 1. FIG. 10 is an enlarged partial perspective view illustrating the configuration of the bottom portion of the outdoor unit 401 according to Embodiment 1. FIG. 11 is an exploded perspective view illustrating the configuration of the bottom portion of the outdoor unit 401 according to Embodiment 1. FIG. 12 is a perspective view illustrating the configurations of the base 301 and the heat exchanger support device 100 according to Embodiment 1.

As illustrated in FIG. 8, the outdoor unit 401 of the air-conditioning apparatus 400 includes the housing 300. The housing 300 has a cuboid shape, for example. The housing 300 has four side surfaces 300*a* and a top surface 300*b*. The heat exchanger support device 100 is mounted on a portion below at least one of the four side surfaces 300*a*. The side surface 300*a* on which the heat exchanger support device 100 is mounted may be called a front surface of the outdoor unit 401.

An air-sending fan 308 is provided above the inside of the housing 300. In the example in FIG. 8, the outdoor unit 401 includes two heat exchangers 304 (see FIG. 6) and two air-sending fans 308. However, this is only an example. The outdoor unit 401 may include one heat exchanger 304 and one air-sending fan 308. When two heat exchangers 304 are stored in the housing 300, the heat exchangers 304 are arranged side by side in the X direction. Likewise, when two air-sending fans 308 are stored in the housing 300, the air-sending fans 308 are arranged side by side in the X direction, as shown in FIG. 8. When the air-sending fan 308 is driven and rotated, outside air is sucked into the housing 300 from the side surfaces 300*a* of the housing 300. The heat exchanger 304 allows heat exchange between sucked outside air and refrigerant flowing through the heat transfer tubes 305. Outside air subjected to heat exchange with the refrigerant is exhausted from the top surface 300*b* of the housing 300 to the outside.

Figure 22:
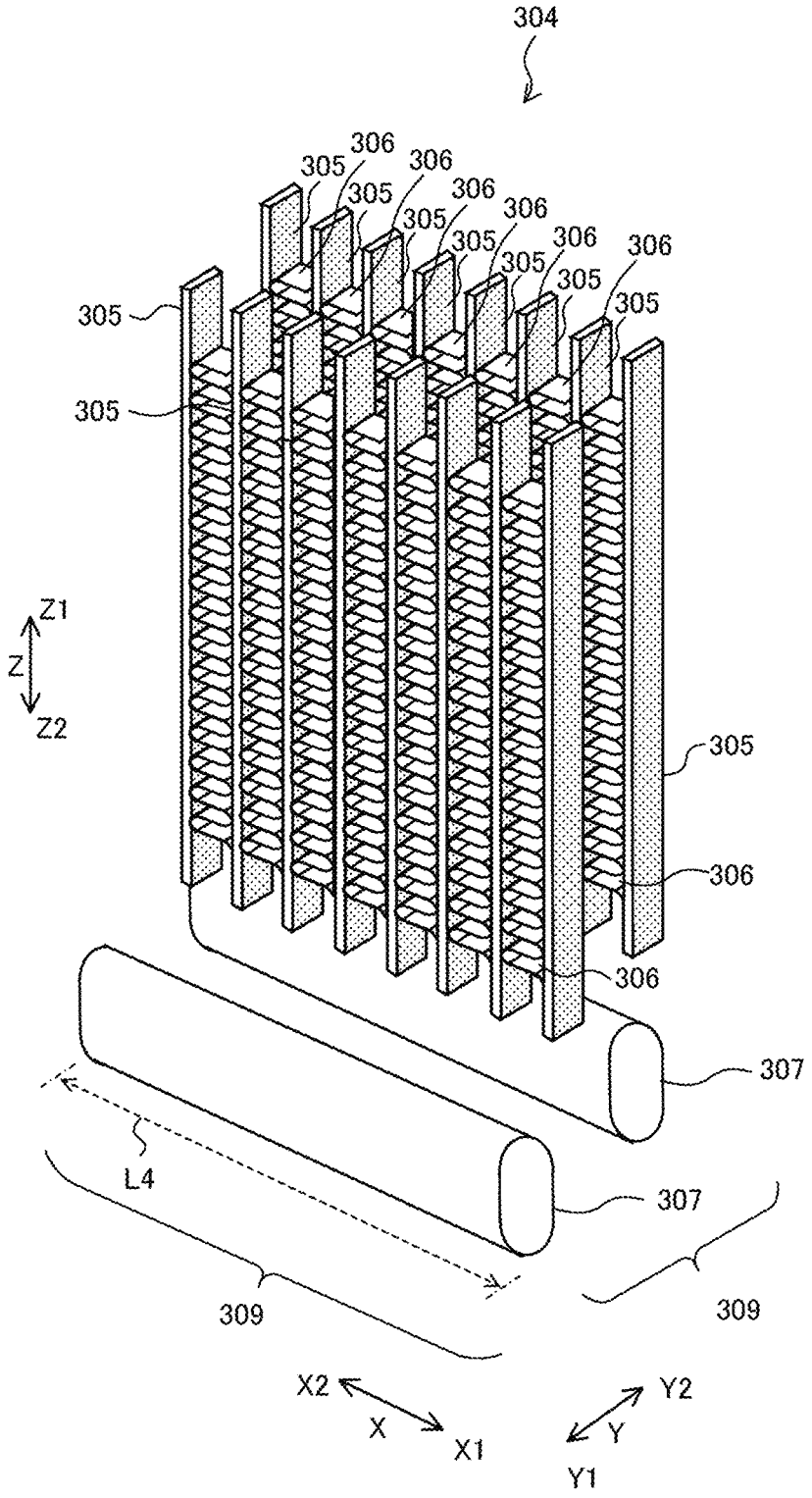
FIG. 22 is an exploded perspective view illustrating an example of the configuration of a heat exchanger 304 provided in an air-conditioning apparatus 400 according to Embodiment 1.

The heat exchanger 304 (see FIG. 6) is stored in the housing 300. The heat exchanger 304 includes heat transfer tubes 305 and fins 306 (see FIG. 22). The heat exchanger 304 is a fin-and-tube heat exchanger, for example. FIG. 22 is an exploded perspective view illustrating an example of the configuration of the heat exchanger 304 provided in the air-conditioning apparatus 400 according to Embodiment 1. The heat transfer tubes 305 axially extends in the up-down direction, that is, the Z direction, as shown in FIGS. 6 and 22. The heat transfer tubes 305 are flat tubes, for example. The plural heat transfer tubes 305 are each disposed in the X direction with an associated space in between, as shown in FIG. 22. The flat surfaces of the heat transfer tubes 305 are parallel with the YZ plane and flat surfaces of adjacent heat transfer tubes 305 face each other. In the examples in FIGS. 6 and 22, the heat transfer tubes 305 are arranged in two rows in the Y direction. The heat exchanger header 307 is provided for each row of heat transfer tubes 305. However, the heat transfer tubes 305 may not be disposed in two rows. That is, the number of rows of heat transfer tubes 305 may be any number including one. The fins 306 are corrugated fins, for example, but the fins 306 are not limited to this type. When the fins 306 are corrugated fins, each of the fins 306 is disposed between adjacent heat transfer tubes 305, as shown in FIG. 22. When the fins 306 are planar fins, the fins 306 are each disposed with an associated space in between in a direction intersecting with the axial direction of the heat transfer tubes 305, and the heat transfer tubes 305 are disposed such that the heat transfer tubes 305 pass through the fins 306. As illustrated in FIG. 6, the heat exchanger headers 307 are connected to the bottom ends of the heat transfer tubes 305.

As illustrated in FIG. 8, the heat exchanger support device 100 is mounted on a portion below the side surface 300*a* of the housing 300. In the example in FIG. 8, one heat exchanger support device 100 is mounted on the housing 300, but this is only an example. Since the two heat exchangers 304 are provided in the housing 300, two heat exchanger support devices 100 may be mounted on the housing 300 and are associated with the respective heat exchangers 304. The base unit 101 of the heat exchanger support device 100 is located in the housing 300, as shown in the perspective view of FIG. 10 and the exploded perspective view of FIG. 11. The inner edge 101*a* (see FIG. 1) of the base unit 101 is located in the internal space of the housing 300. The outer edge 101*b* (see FIG. 1) of the base unit 101 is also located in the internal space of the housing 300, but is located further outward of the housing 300 than is the inner edge 101*a*. The inner edge 101*a* and the outer edge 101*b* face each other, as shown in FIG. 5. The heat exchanger protection wall 200 is disposed in the same plane as the side surface 300*a* of the housing 300 and is exposed outside.

Base legs 303 are provided at a lower portion of the housing 300, as shown in FIG. 8. The base legs 303 are support components that support the base 301 (see FIG. 9) disposed under the internal space of the housing 300. A body 303*a* of the base leg 303 has an angular U shape in a side view, as shown in FIG. 6, and is opened toward the outside of the housing 300. A mounting portion 303*b* is provided at the top edge of the body 303*a* of the base leg 303. The mounting portion 303*b* extends upward in the Z direction from the top edge of the body 303*a*. A screw hole is opened in the mounting portion 303*b*. A bolt is inserted into the screw hole and a nut is screwed into the bolt and thus fastens the heat exchanger protection wall 200 to the base leg 303, as shown in FIG. 6. When necessary, a leg cover 303*c* (see FIG. 18) is provided for the opening of the body 303*a* cut in the angular U shape. The provision of the leg cover 303*c* prevents the entry of foreign matter, such as small stones, into the base leg 303.

As illustrated in FIGS. 6, 10, and 11, the heat exchanger support device 100 is disposed such that the longitudinal direction of the base unit 101 is parallel with the widthwise direction of the heat exchanger 304. The widthwise direction of the heat exchanger 304 is the stacking direction of the heat transfer tubes 305 and is the X direction. The heat exchanger support device 100 is disposed such that the widthwise direction of the base unit 101 is parallel with the depth direction of the heat exchanger 304. The depth direction of the heat exchanger 304 is a direction intersecting with the stacking direction of the heat transfer tubes 305, and more specifically, it is the Y direction.

The length of an installation region 309 of the heat exchanger 304 in the Y direction is defined as a "length L1", as shown in FIG. 6, while the length of the base unit 101 of the heat exchanger support device 100 in the Y direction is defined as a "length L2", as shown in FIG. 5. The length L2 of the base unit 101 in the Y direction is longer than the length L1 of the installation region 309 of the heat exchanger 304 in the Y direction. In this manner, the length L2 of the base unit 101 of the heat exchanger support device 100 in the widthwise direction is longer than the length L1, which is the entire length of the heat exchanger 304 in the depth direction. The installation region 309 of the heat exchanger 304 is a region where the heat transfer tubes 305 and the heat exchanger headers 307 of the heat exchanger 304 are installed.

A length L3 (see FIG. 3) of the base unit 101 of the heat exchanger support device 100 in the longitudinal direction is longer than or equal to a length L4 (see FIG. 22), which is the entire length of the installation region 309 (see FIG. 22) of the heat exchanger 304 in the X direction. In this manner, the length L3 of the base unit 101 of the heat exchanger support device 100 in the longitudinal direction is longer than the length L4, which is the entire length of the heat exchanger 304 in the widthwise direction. In the example in FIG. 8, two heat exchangers 304 are provided in the housing 300. When plural heat exchangers 304 are provided as in this example, the length L4 of the installation region 309 (see FIG. 22) of the heat exchangers 304 in the X direction is the total length of all the heat exchangers 304 stored in the housing 300 in the X direction, as shown in FIG. 8.

In this manner, the base unit 101 is disposed such that the base unit 101 covers the entirety of the bottom surfaces of the heat exchangers 304 including the heat exchanger headers 307. Hence, the base unit 101 receives the entirety of drain water flowing down along the surfaces of the heat transfer tubes 305.

The base 301 is disposed below the internal space of the housing 300 of the outdoor unit 401. The base 301 is disposed on the base legs 303, as shown in FIG. 6. The base unit 101 of the heat exchanger support device 100 is disposed above the base 301. The base unit 101 is thus located between the heat exchanger header 307 provided in the heat exchanger 304 and the base 301 in the Z direction. The heat exchanger support device 100 is made of a resin, as discussed above. The heat exchanger header 307 is made of aluminum, while the base 301 is made of steel. When the heat exchanger header 307 and the base 301 contact each other, galvanic corrosion occurs. Galvanic corrosion is a phenomenon in which corrosion occurs when metals having a potential difference contact each other and exchange electrons. In Embodiment 1, the heat exchanger support device 100 made of a resin is disposed between the heat exchanger header 307 and the base 301, thereby reducing the occurrence of galvanic corrosion.

As illustrated in FIGS. 9 and 12, the base 301 has a rectangular shape in a plan view. The base 301 is made of a corrugated steel plate. Working the base to have a corrugated shape can obtain the effect of making it easy for drain water to flow on the base and also the effect of providing a strength resistant to bending and deflection deformation to the base. The base 301 includes rising portions 301*a* at both ends in the X direction. The rising portions 301*a* are formed by bending both side edges of the base 301, which are provided in the X direction, upward in the Z direction. The base 301 also includes a second drain hole 302 and a drain groove 310. Passing through the second drain hole 302, drain water generated from frost melted during a defrost operation is drained to the outside of the housing 300. The drain groove 310 guides drain water to the second drain hole 302. The base 301 also has a front-surface side edge 301*b*, which forms one side edge in the Y direction, and a back-surface side edge 301*c*, which forms the other side edge in the Y direction. The second drain hole 302 is opened closer to the front-surface side edge 301*b* than the center in the Y direction. The second drain hole 302 is opened in the vicinity of the front-surface side edge 301*b*. Multiple second drain holes 302 are each provided in the X direction with an associated space in between. The drain groove 310 extends in the Y direction. The drain groove 310 is disposed in association with the corresponding second drain hole 302.

As discussed above, the first drain hole 104 opened in the heat exchanger support device 100 is located right above the second drain hole 302 of the base 301. Alternatively, the first drain hole 104 is located inward of the second drain hole 302 of the base 301 and positioned at the same level as the second drain hole 302, as shown in FIG. 6. The first drain hole 104 opened in the heat exchanger support device 100 is thus located at a position corresponding to the position of the second drain hole 302 of the base 301. The opening area of the first drain hole 104 is smaller than the opening area the second drain hole 302. Accordingly, the first drain hole 104 is contained in the second drain hole 302 as viewed from above. As a result, as indicated by the arrow in FIG. 6, drain water flowing on the water guide face 105 and passing through the first drain hole 104 along the first drain path P1 is directly drained from the first drain hole 104 to the outside of the housing 300 without contacting the second drain hole 302 and the base 301.

As described above, the first drain hole 104 opened in a resin is disposed right above or inward of the second drain hole 302 of the base 301 so that drain water is directly drained from the first drain hole 104 to the outside of the housing 300 without contacting the base 301. This prevents drain water from being accumulated in the base 301. Hence, the base 301 is not covered with ice, and the second drain hole 302 is not blocked by ice. In Embodiment 1, therefore, unlike a device of the related art, ice is prevented from growing to the bottom portion of the heat exchanger, thereby making it possible to protect the fins 306, heat exchanger headers 307, and heat transfer tubes 305 from damage that would be caused by frozen water.

(First Drain Path P1)

Figure 13:
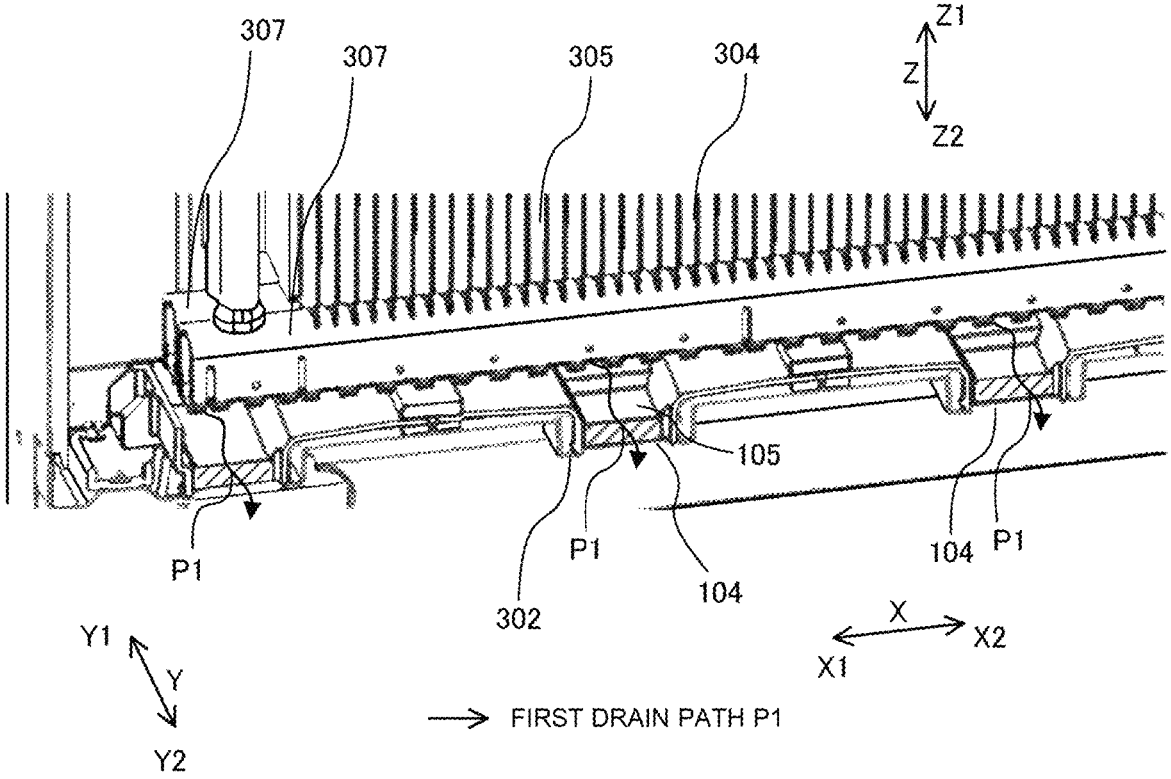
FIG. 13 is a partial perspective view illustrating a first drain path P1 in the heat exchanger support device 100 according to Embodiment 1.

The first drain path P1 will be explained below with reference to FIGS. 6 and 13. FIG. 13 is a partial perspective view illustrating the first drain path P1 in the heat exchanger support device 100 according to Embodiment 1. In FIG. 13, a cross section obtained by cutting the water guide face 105 of the heat exchanger support device 100 along a virtual plane parallel with the XZ plane is shown. In FIG. 13, the side rib 106 is not shown. FIG. 13 shows a state in which the heat exchanger support device 100 is seen from the internal space of the housing 300. Drain water first flows down on the surfaces of the heat transfer tubes 305 axially extending in the Z direction. Then, the drain water is received by the base unit 101 of the heat exchanger support device 100. The base unit 101 includes the main surface 102, as discussed above. The main surface 102 has a first main surface 102*a* (see FIG. 4) and a second main surface 102*b* (see FIG. 4), which will be discussed later in detail with reference to FIG. 4 when the second drain path P2 is described. Each of the first and second main surfaces 102*a* and 102*b* is inclined and descends toward the groove 103. Since the first and second main surfaces 102*a* and 102*b* are inclined in the X direction, the drain water received by the main surface 102 of the base unit 101 flows toward the groove 103 in the X direction. Then, as illustrated in FIGS. 6 and 13, the drain water flowing down in the groove 103 flows on the water guide face 105 positioned in the groove 103 and reaches the first drain hole 104. The drain water is then directly drained from the first drain hole 104 to the outside of the housing 300 without contacting the second drain hole 302 and the base 301.

(Second Drain Path P2)

Figure 14:
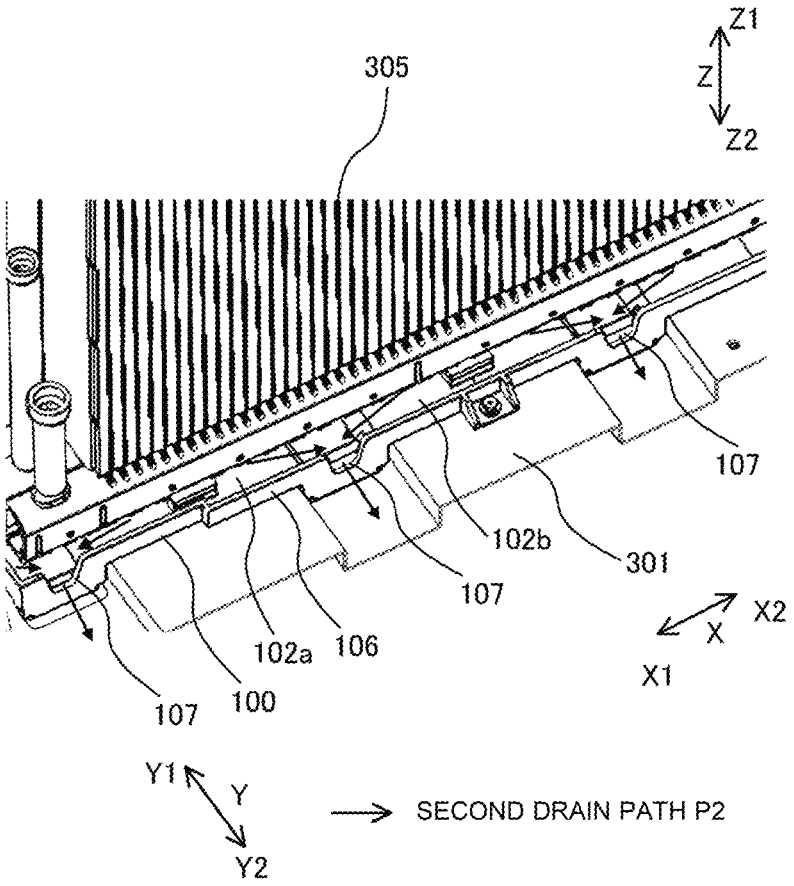
FIG. 14 is a partial perspective view illustrating a second drain path P2 in the heat exchanger support device 100 according to Embodiment 1.
Figure 15:
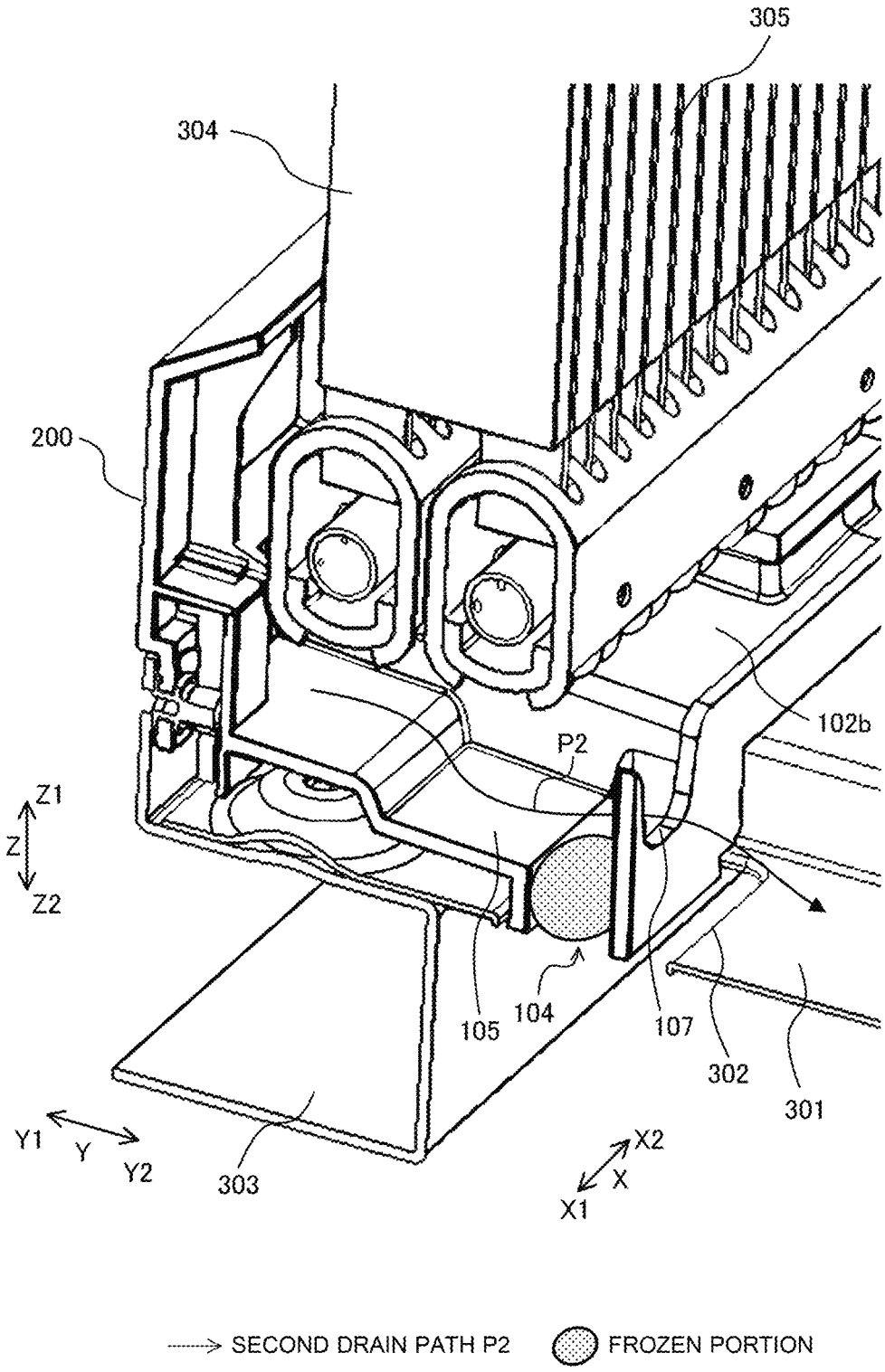
FIG. 15 is a partial perspective view illustrating the second drain path P2 in the heat exchanger support device 100 according to Embodiment 1.

The second drain path P2 will be explained below with reference to FIGS. 14 and 15. FIG. 14 is a partial perspective view illustrating the second drain path P2 in the heat exchanger support device 100 according to Embodiment 1. FIG. 14 shows a state in which the heat exchanger support device 100 is seen from the internal space of the housing 300. FIG. 15 is a partial perspective view illustrating the second drain path P2 in the heat exchanger support device 100 according to Embodiment 1.

The second drain path P2 is a drain path used when the first drain hole 104 is frozen. When the first drain hole 104 is frozen, drain water flows by passing through the main surface 102, water guide face 105, and notch 107 of the heat exchanger support device 100, as indicated by the arrows in FIGS. 14 and 15. This will be described below in detail.

The main surface 102 will first be explained below with reference to FIG. 4, which has been discussed. The main surface 102 on the base unit 101 of the heat exchanger support device 100 includes the first main surface 102*a* and the second main surface 102*b*. The first main surface 102*a* and the second main surface 102*b* are located at one side and at the other side of the groove 103 in the longitudinal direction of the base unit 101, as shown in FIG. 4. The first and second main surfaces 102*a* and 102*b* are inclined and descend toward the groove 103 in the longitudinal direction of the base unit 101, as shown in FIG. 4. Projecting portions 108 are provided on the main surface 102, as shown in FIG. 4. The heat exchanger header 307 is placed on the projecting portions 108 such that the projecting portions 108 support the heat exchanger header 307. Main surfaces 108*a* of the projecting portions 108 are not inclined and are located on a flat level.

The first main surface 102*a* is located from the position at which a projecting portion 108 is provided to the position at which the groove 103 is formed. More specifically, the start point of the first main surface 102*a* corresponds to the center of the projecting portion 108 in the X direction. The end point of the first main surface 102*a* corresponds to one side of the groove 103 in the X direction. The first main surface 102*a* is inclined downward from the start point to the end point.

Likewise, the second main surface 102*b* is located from the position at which a projecting portion 108 is provided to the position at which the groove 103 is formed. More specifically, the start point of the second main surface 102*b* corresponds to the center of the projecting portion 108 in the X direction. The end point of the second main surface 102*b* corresponds to the other side of the groove 103 in the X direction. The second main surface 102*b* is inclined downward from the start point to the end point.

Because of the inclination of the first and second main surfaces 102*a* and 102*b* in the X direction, drain water received by the main surface 102 flows toward the groove 103 in the X direction. The drain water flowing down in the groove 103 then passes through the water guide face 105 and flows from the notch 107 toward the base 301.

The first and second main surfaces 102*a* and 102*b* are both inclined, not only in the X direction, but also in the Y direction. This will be explained by taking the second main surface 102*b* as an example with reference to FIG. 7, which has been discussed. The second main surface 102*b* is inclined downward in a direction from the second end 103*b* to the first end 103*a* of the groove 103. Likewise, the first main surface 102*a* is also inclined downward in a direction from the second end 103*b* to the first end 103*a* of the groove 103.

Because of the inclination of the first and second main surfaces 102*a* and 102*b* in the Y direction, drain water received by the main surface 102 flows toward the first end 103*a* of the groove 103 in the Y direction. The drain water flowing down in the groove 103 then passes through the water guide face 105 and flows from the notch 107 toward the base 301.

As described above, since the first and second main surfaces 102*a* and 102*b* are inclined both in the X direction and in the Y direction, drain water efficiently flows toward the first drain hole 104 in the groove 103.

In the second drain path P2, drain water received by the main surface 102 of the heat exchanger support device 100 flows by passing through the water guide face 105 and the notch 107, as indicated by the arrows in FIG. 14.

As described above, in a case in which the first drain hole 104 is frozen, the water guide face 105 and the notch 107 define the second drain path P2.

(Third Drain Path P3)

Figure 16:
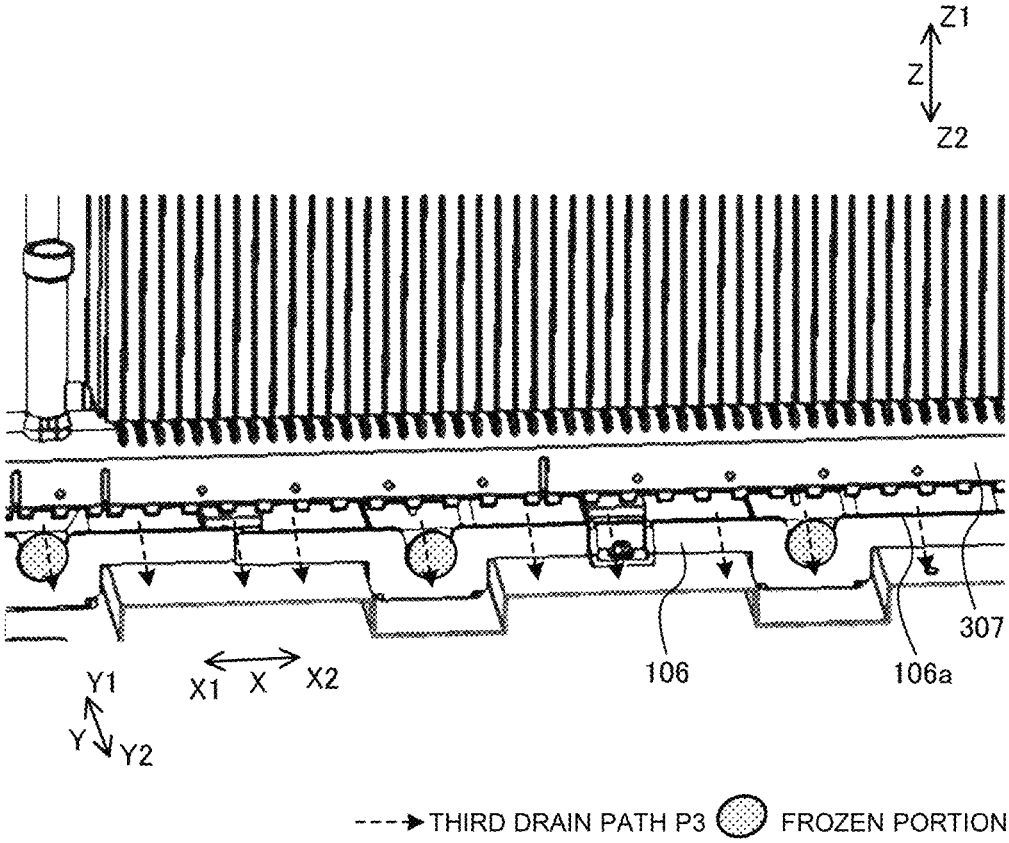
FIG. 16 is a partial perspective view illustrating a third drain path P3 in the heat exchanger support device 100 according to Embodiment 1.
Figure 17:
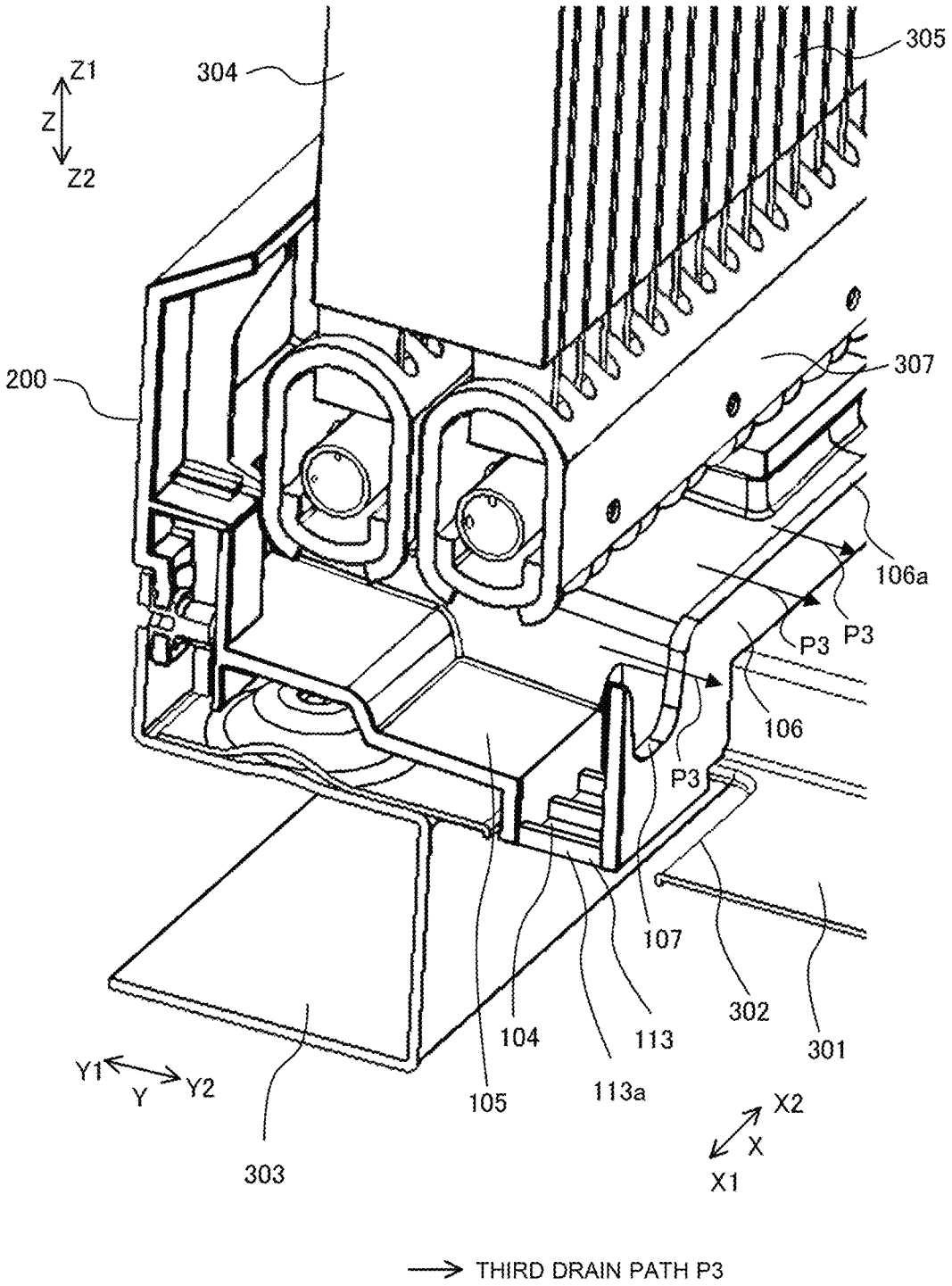
FIG. 17 is a partial perspective view illustrating the third drain path P3 in the heat exchanger support device 100 according to Embodiment 1.
Figure 18:
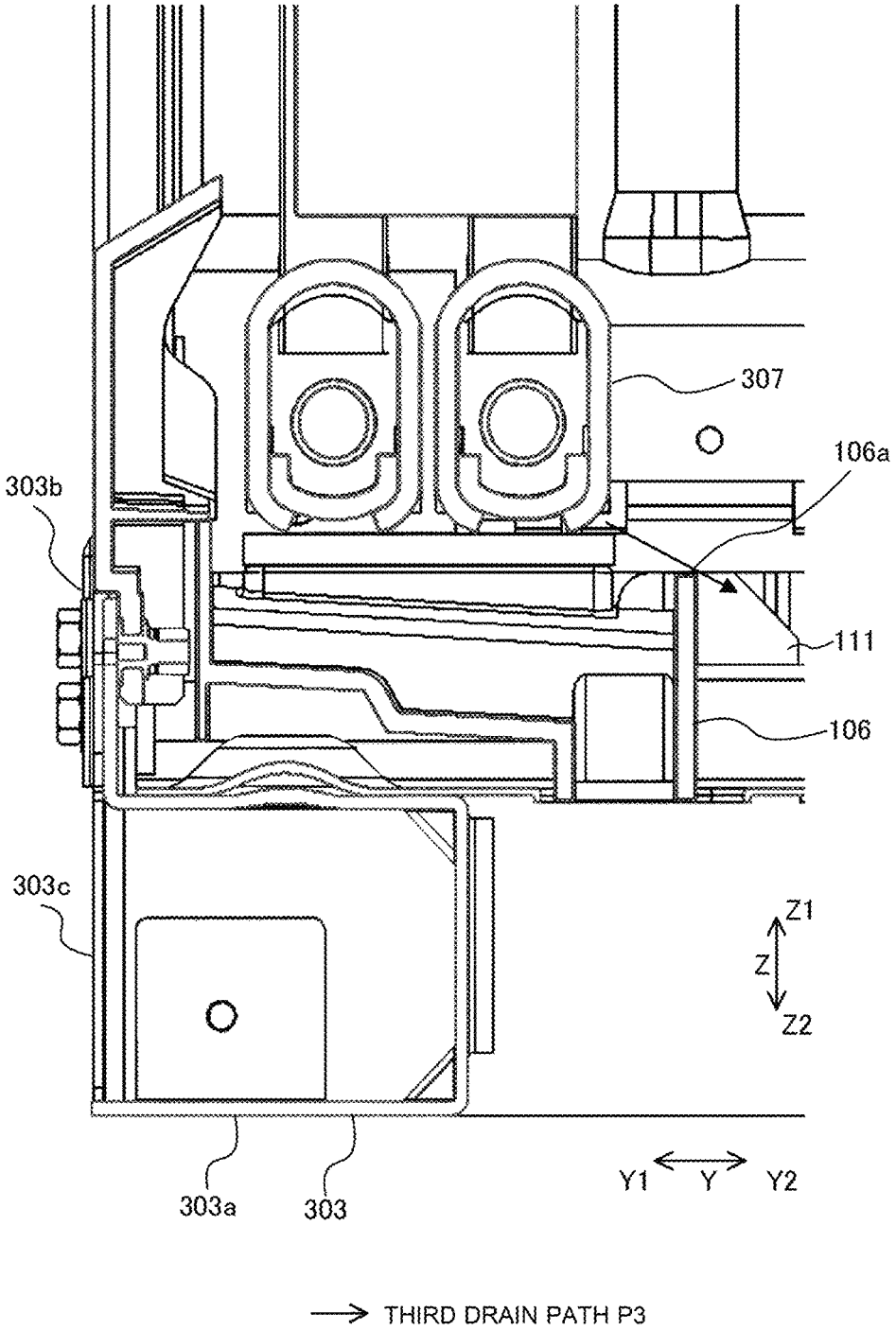
FIG. 18 is a partial perspective view illustrating the third drain path P3 in the heat exchanger support device 100 according to Embodiment 1.

A third drain path P3 will be explained below with reference to FIGS. 16 through 18. FIG. 16 is a partial perspective view illustrating the third drain path P3 in the heat exchanger support device 100 according to Embodiment 1. FIG. 16 shows a state in which the heat exchanger support device 100 is seen from the outer side of the housing 300. FIG. 17 is a partial perspective view illustrating the third drain path P3 in the heat exchanger support device 100 according to Embodiment 1. FIG. 18 is a partial perspective view illustrating the third drain path P3 in the heat exchanger support device 100 according to Embodiment 1.

The third drain path P3 is a drain path used when the first drain hole 104 and the notch 107 are frozen. When the first drain hole 104 and the notch 107 are frozen, drain water passes through the water guide face 105 and then flows by passing over the top end 106*a* of the side rib 106, as indicated by the arrows in FIGS. 16 through 18. This will be described below in detail.

As illustrated in FIGS. 16 through 18, the top end 106*a* of the side rib 106 is located at a lower position than the installation position of the heat exchanger 304. More specifically, the top end 106*a* of the side rib 106 is located at a lower position than the installation position of the heat exchanger header 307 of the heat exchanger 304, as shown in FIG. 18. Accordingly, as indicated by the arrows in FIGS. 16 and 17, in the third drain path P3, drain water flows on the water guide face 105, passes over the top end 106*a* of the side rib 106, and flows toward the base 301 located inside the housing 300.

In this manner, in a case in which the first drain hole 104 and the notch 107 are frozen, the water guide face 105 and the top end 106*a* of the side rib 106 define the third drain path P3. This prevents the heat exchanger header 307 from being submerged in (under) drain water.

(Fourth Drain Path P4)

Figure 19:
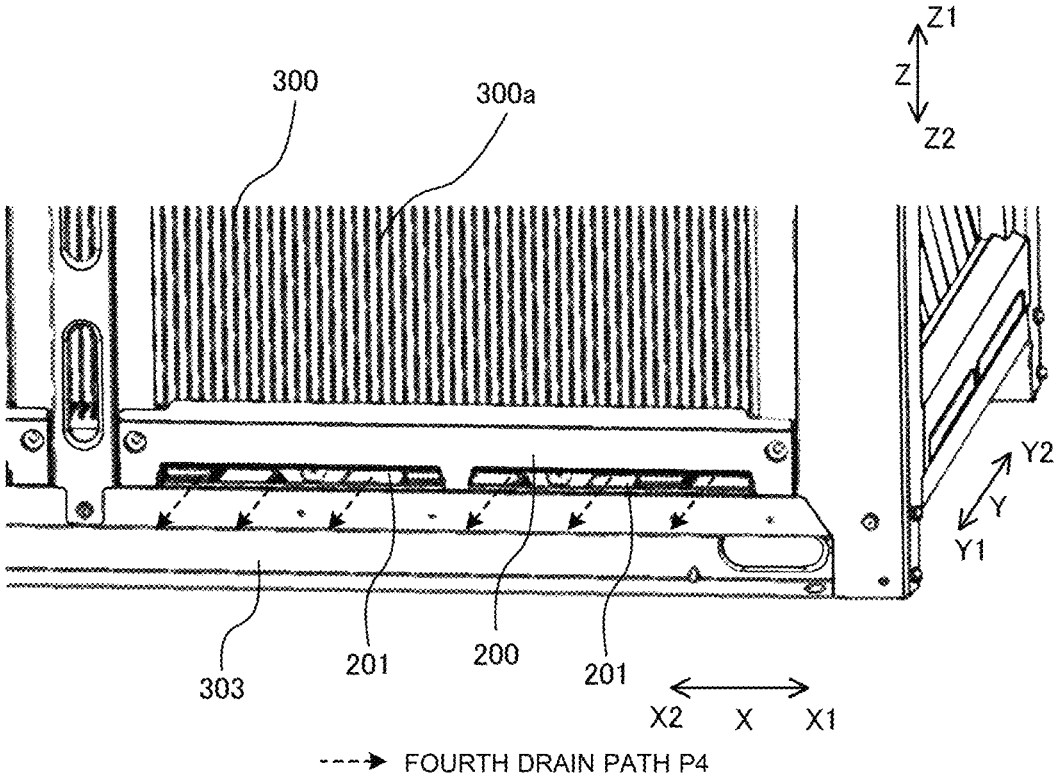
FIG. 19 is a partial perspective view illustrating a fourth drain path P4 in the heat exchanger support device 100 according to Embodiment 1.
Figure 20:
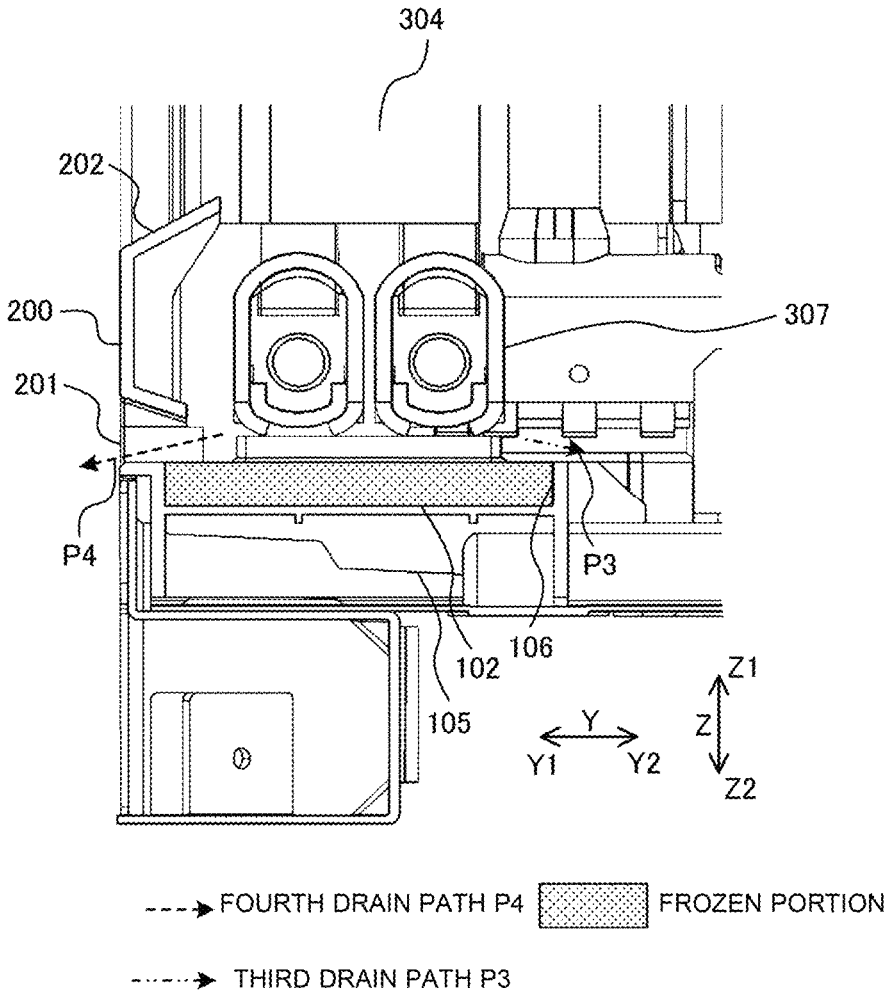
FIG. 20 is a sectional view illustrating the fourth drain path P4 in the heat exchanger support device 100 according to Embodiment 1.

A fourth drain path P4 will be explained below with reference to FIGS. 19 and 20. FIG. 19 is a partial perspective view illustrating the fourth drain path P4 in the heat exchanger support device 100 according to Embodiment 1. FIG. 20 is a sectional view illustrating the fourth drain path P4 in the heat exchanger support device 100 according to Embodiment 1.

As in the third drain path P3, the fourth drain path P4 is a drain path used when the first drain hole 104 and the notch 107 are frozen. As indicated by the arrows in FIGS. 19 and 20, when the first drain hole 104 and the notch 107 are frozen, drain water passes through the main surface 102 of the base unit 101 and the drain gates 201 of the heat exchanger protection wall 200 and flows toward the outside of the housing 300. This will be described below in detail.

As stated above, the drain gates 201 are provided at the bottom end of the heat exchanger protection wall 200. The drain gates 201 are narrow, slit-like gaps, as shown in FIG. 2. The drain gates 201 are formed such that the drain gates 201 are hollowed upward from the bottom end 200*a* of the heat exchanger protection wall 200.

As illustrated in FIGS. 19 and 20, when the first drain hole 104 and the notch 107 are frozen, drain water passes through the drain gates 201 and flows toward the outside of the housing 300.

In this manner, in a case in which the first drain hole 104 and the notch 107 are frozen, the main surface 102 of the base unit 101 and the drain gates 201 define the fourth drain path P4.

(Mounting of Heat Exchanger Support Device 100 on Base 301)

Figure 21:
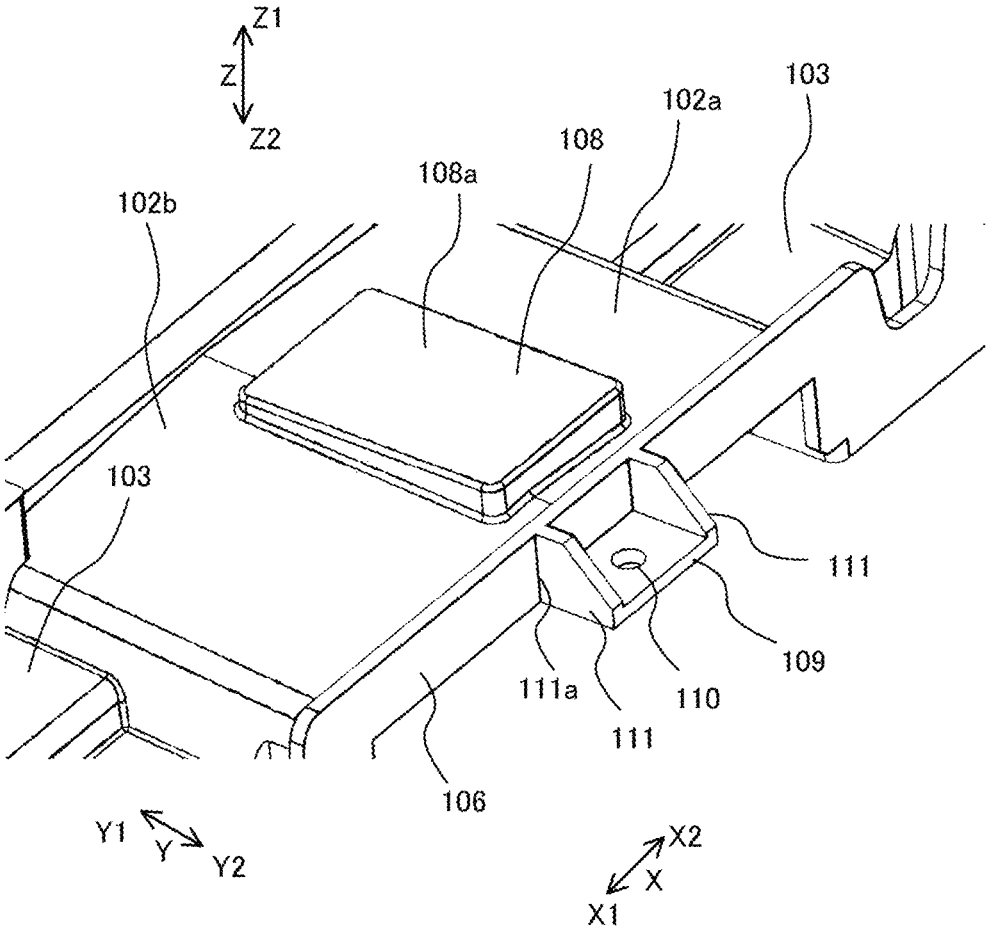
FIG. 21 is a perspective view illustrating the configuration of a mounting portion 109 provided in the heat exchanger support device 100 according to Embodiment 1.

Mounting of the heat exchanger support device 100 on the base 301 will be described below with reference to FIG. 21. FIG. 21 is a perspective view illustrating the configuration of a mounting portion 109 provided in the heat exchanger support device 100 according to Embodiment 1. As shown in FIG. 21, the heat exchanger support device 100 includes the mounting portion 109 having a planar shape.

The mounting portion 109 is fixed to the side rib 106. The mounting portion 109 has a rectangular shape in a plan view. The mounting portion 109 extends in a direction intersecting with the rising direction of the side rib 106. That is, the mounting portion 109 extends in the Y direction intersecting with the Z direction. The mounting portion 109 protrudes from the side rib 106 in a direction away from the base unit 101. The mounting portion 109 has a screw hole 110 passing through the planar thickness of the mounting portion 109. The mounting portion 109 is fastened to the base 301 by a screw inserted into the screw hole 110. The fixture inserted into the screw hole 110 may be a bolt and a nut.

Planar reinforcing ribs 111 are provided for the mounting portion 109. The reinforcing ribs 111 are disposed at both ends of the mounting portion 109 in the longitudinal direction of the base unit 101. The reinforcing ribs 111 rise from both of the X-direction ends of the mounting portion 109 upward in the Z direction. The reinforcing ribs 111 have a triangular or pentagonal shape in a side view. An end 111*a* of each reinforcing rib 111 extending in the up-down direction is fixed to the side rib 106. Providing the reinforcing ribs 111 for the mounting portion 109 enhances the strength of the mounting portion 109.

(Modified Examples of First Drain Hole 104)

As illustrated in FIG. 17, the first drain hole 104 may have a safety guard 113 that prevents the entry of foreign matter into the first drain hole 104. The foreign matter is a finger of a user, for example. As shown in FIG. 17, the safety guard 113 has multiple bar-like components 113*a* fixed to both of the Y-direction ends of the first drain hole 104. The bar-like components 113*a* extend in the Y direction. The bar-like components 113*a* have a prism shape, for example, but may have a circular cylindrical shape. The multiple bar-like components 113*a* are each arranged in the X direction with an associated space in between. The safety guard 113 thus has a planar shape similar to one type of fence.

As illustrated in FIG. 17, the heat exchanger 304 is disposed above the first drain hole 104. More specifically, the heat exchanger header 307 of the heat exchanger 304 is disposed above the first drain hole 104. There may be a case in which the heat exchanger header 307 also serves as a gas header and, in this case, the heat exchanger header 307 becomes considerably hot. The safety guard 113 may thus be provided for the first drain hole 104 not to let a finger of a user put in the first drain hole 104 from outside. In this case, a finger of a user is hampered by the safety guard 113 and does not enter the first drain hole 104, thereby securing the safety.

An example of the safety guard 113 having a planar shape like one type of fence is shown in FIG. 17. However, this is only an example. The safety guard 113 may have a planar and lattice-like shape, for example. In this case, a second bar-like component (not shown) is provided between two adjacent bar-like components 113*a*. The second bar-like component extends from one side to the other side of the two adjacent bar-like components 113*a* in the X direction. Multiple second bar-like components are each disposed with an associated space in between in the Y direction. The second bar-like components have a prism shape, for example, but may have a circular cylindrical shape. The bar-like components 113*a* and the second bar-like components are integrally formed from a resin.

In this manner, the safety guard 113 has a planar shape like one type of fence or a planar and lattice-like shape. The safety guard 113 is made of a heat-resistant resin, such as foaming resin. The safety guard 113 may be integrally formed from a resin, together with another element, such as the base unit 101. Alternatively, the safety guard 113 may be formed separately from another element, such as the base unit 101, and be attached to the inner side of the first drain hole 104.

As described above, in Embodiment 1, the heat exchanger support device 100 includes the main surface 102, groove 103, water guide face 105, and first drain hole 104. With this configuration, the heat exchanger support device 100 causes drain water received by the main surface 102 to flow down on the water guide face 105 in the groove 103 and to be drained to the outside of the housing 300 through the first drain hole 104. The first drain hole 104 is located right above the second drain hole 302 opened in the base 301 or inward of the second drain hole 302. Drain water is thus drained to the outside of the housing 300 without contacting the base 301. By draining drain water from the heat exchanger 304 efficiently, the heat exchanger 304 is prevented from being damaged by ice.

In Embodiment 1, the heat exchanger support device 100 is made of a resin. The heat exchanger support device 100 is disposed between the heat exchanger header 307 made of aluminum and the base 301 made of steel. The heat exchanger support device 100 is thus configured to reduce the occurrence of galvanic corrosion.

In Embodiment 1, the second drain path P2, which causes drain water to flow down toward the inside of the housing 300 and to be drained, is provided and is used when the first drain hole 104 is frozen. The second drain path P2 includes the notch 107 cut in the side rib 106 of the heat exchanger support device 100. Additionally, in Embodiment 1, the third drain path P3 and the fourth drain path P4 for draining drain water are provided and are used when the first drain hole 104 and the notch 107 are frozen. The third drain path P3 includes the top end 106*a* of the side rib 106 located at a lower position than the installation position of the heat exchanger 304. The fourth drain path P4 includes the drain gates 201 provided in the heat exchanger protection wall 200. In this manner, in Embodiment 1, the heat exchanger support device 100 includes the notch 107 for draining water inside the housing 300, the side rib 106 located at a lower position than the installation position of the heat exchanger 304, and the drain gates 201 so that multiple drain paths are secured for draining water in case certain elements are frozen. Securing such multiple drain paths enhances the strength of the outdoor unit 401 in case the outdoor unit 401 is frozen.

In Embodiment 1, the heat exchanger protection wall 200 is provided for the heat exchanger support device 100. The heat exchanger protection wall 200 is disposed outside the heat exchanger header 307 and thus covers the heat exchanger header 307. This enables the heat exchanger protection wall 200 to protect the heat exchanger header 307 from damage caused by foreign matter, such as small stones, and to prevent the heat exchanger header 307 from being frozen caused by wind.

REFERENCE SIGNS LIST

100: heat exchanger support device, 101: base unit, 101*a*: inner edge, 101*b*: outer edge, 102: main surface, 102*a*: first main surface, 102*b*: second main surface, 103: groove, 103*a*: first end, 103*b*: second end, 104: first drain hole, 105: water guide face, 106: side nib, 106*a*: top end, 107: notch, 108: projecting portion, 108*a*: main surface, 109: mounting portion, 110: screw hole, 111: reinforcing rib, 111*a*: end, 112: side flat portion, 113: safety guard, 113*a*: bar-like component, 200: heat exchanger protection wall, 200*a*: bottom end, 201: drain gate, 202: top bending portion, 300: housing, 300*a*: side surface, 300*b*: top surface, 301: base, 301*a*: rising portion, 301*b*: front-surface side edge, 301*c*: back-surface side edge, 302: second drain hole, 303: base leg, 303*a*: body, 303*b*: mounting portion, 303*c*: leg cover, 304: heat exchanger, 305: heat transfer tube, 306: fin, 307: heat exchanger header, 308: air-sending fan, 309: installation region, 310: drain groove, 400: air-conditioning apparatus, 401: outdoor unit, 1051: step portion, 1052: tilt surface, 1052*a*: first tilt surface portion, 1052*b*: second tilt surface portion, 1052*c*: third tilt surface portion, 1052*d*: step, P1: first drain path, P2: second drain path, P3: third drain path, P4: fourth drain path, $\alpha$1: first tilt angle, $\alpha$2: second tilt angle, $\alpha$3: third tilt angle

The invention claimed is:

1. A heat exchanger support assembly comprising:

a heat exchanger;

a base; and a support device that is made of resin and that is disposed between the heat exchanger and the base, the support device comprising:

a base unit having an elongated shape and including a plurality of adjacent drain sections, each drain section comprising:

a flat surface configured to support the heat exchanger;

a first main surface that is recessed from the flat surface and inclined downward away from the flat surface in a first direction; and a second main surface that is recessed from the flat surface and inclined downward away from the flat surface in a second direction that is opposite the first direction;

wherein a groove is located in the base unit at an end of each of the first and second main surfaces that is opposite the flat surface, the groove being recessed downwardly from the first and second main surfaces;

wherein a water guide face is located in the groove, the water guide face progressively or continuously descending from a second end of the groove toward a first end of the groove, the second end being positioned opposite to the first end in an extending direction of the groove that is perpendicular to a longitudinal extent of the base unit; and wherein a drain hole is located at the first end of the groove and defined between the water guide face and a side wall of the base unit, the drain hole being a through-hole.

2. The heat exchanger support device of claim 1, wherein the heat exchanger includes a plurality of heat transfer tubes that are each arranged in a widthwise direction of the heat exchanger with an associated space in between and that axially extend in an up-down direction, and the base unit is disposed such that a longitudinal direction of the base unit is parallel with the widthwise direction of the heat exchanger, the base unit being provided for an entirety of a bottom surface of the heat exchanger.

3. The heat exchanger support device of claim 2, wherein the drain hole comprises a first drain hole;

the heat exchanger is disposed in an internal space of a housing, the base unit is located below at least one side surface of the housing, the base is located below the internal space of the housing and includes a second drain hole, the second drain hole being used for draining drain water generated in the heat exchanger to outside of the housing, and the base unit is disposed between the heat exchanger and the base in an up-down direction such that the heat exchanger and the base do not contact each other.

4. The heat exchanger support device of claim 3, wherein the first drain hole is disposed at a position corresponding to a position of the second drain hole of the base, the first drain hole is located directly above the second drain hole of the base or is located inward of the second drain hole of the base and positioned at a level identical to a level of the second drain hole, and the water guide face and the first drain hole define a first drain path, in the first drain path, the drain water flowing on the water guide face, passing through the first drain hole, and flowing toward an outside of the housing from the first drain hole.

5. The heat exchanger support device of claim 3, wherein the base unit has an inner edge, the inner edge being one edge of the base unit in the widthwise direction and being located in the internal space of the housing, the heat exchanger support device further comprises:

a side rib provided at the inner edge, the side rib having an elongated and planar shape extending in a longitudinal direction of the base unit and rising upward from the inner edge; and a notch provided at a top end of the side rib, the notch being located at a position corresponding to a position of the groove in the longitudinal direction of the base unit and being hollowed downward from the top end of the side rib, and when the first drain hole is frozen, the water guide face and the notch define a second drain path, in the second drain path, the drain water flowing on the water guide face, passing through the notch, and flowing toward the base located inside the housing.

6. The heat exchanger support device of claim 5, wherein the top end of the side rib is located at a lower position than an installation position of the heat exchanger, and when the first drain hole and the notch are frozen, the water guide face and the top end of the side rib define a third drain path, in the third drain path, the drain water flowing on the water guide face, passing over the top end of the side rib, and flowing toward the base located inside the housing.

7. The heat exchanger support device of claim 5, wherein the heat exchanger is disposed in an internal space of a housing, the base unit has an inner edge, the inner edge being one edge of the base unit in the widthwise direction and being located in the internal space of the housing, and an outer edge, the outer edge being an other edge of the base unit in the widthwise direction, facing the inner edge, and being located further outward of the housing than is the inner edge, the heat exchanger support device further comprises:

a heat exchanger protection wall provided at the outer edge, the heat exchanger protection wall having an elongated and planar shape extending in a longitudinal direction of the base unit and rising upward from the outer edge, the heat exchanger includes a heat exchanger header connected to bottom ends of the plurality of heat transfer tubes, and the heat exchanger protection wall is disposed further outward of the housing than is the heat exchanger header.

8. The heat exchanger support device of claim 7, further comprising:

a drain gate provided at a bottom end of the heat exchanger protection wall, the drain gate being formed such that the drain gate is hollowed upward from the bottom end of the heat exchanger protection wall, wherein, when the first drain hole and the notch are frozen, the main surface of the base unit and the drain gate define a fourth drain path, in the fourth drain path, the drain water flowing on the main surface of the base unit, passing through the drain gate, and flowing toward an outside of the housing.

9. The heat exchanger support device of claim 1, wherein the water guide face of the base unit includes a step portion that progressively descends from the second end of the groove toward the drain hole.

10. The heat exchanger support device of claim 9, wherein the step portion has a tilt surface that continuously descends from the second end of the groove toward the drain hole.

11. The heat exchanger support device of claim 1, wherein the drain hole has a planar safety guard the safety guard preventing entry of foreign matter into the drain hole.

* * * * *